US012662913B2

(12) United States Patent
Asthana et al.

(10) Patent No.: US 12,662,913 B2
(45) Date of Patent: Jun. 23, 2026

(54) SYSTEMS AND METHODS FOR ANCHORING A SUB-SURFACE COMPLETION UNIT IN A WELLBORE

(71) Applicant: Saudi Arabian Oil Company, Dhahran (SA)

(72) Inventors: Pranay Asthana, Dhahran (SA); Muhammad Arsalan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/933,220

(22) Filed: Oct. 31, 2024

(65) Prior Publication Data

US 2025/0137359 A1 May 1, 2025

Related U.S. Application Data

(60) Provisional application No. 63/594,761, filed on Oct. 31, 2023.

(51) Int. Cl.
*E21B 23/01* (2006.01)
*E21B 43/10* (2006.01)

(52) U.S. Cl.
CPC ..... *E21B 43/103* (2013.01); *E21B 23/01* (2013.01)

(58) Field of Classification Search
CPC ..... E21B 23/01; E21B 33/12
See application file for complete search history.

(56) References Cited

U.S. PATENT DOCUMENTS 5,613,557 A * 3/1997 Blount ..... E21B 23/06 166/299
10,367,434 B2 7/2019 Ahmad et al.
10,533,393 B2 1/2020 Arsalan et al.
10,563,478 B2 2/2020 Arsalan et al.
(Continued)

FOREIGN PATENT DOCUMENTS

WO WO-2020068037 A1 * 4/2020 ..... E21B 33/127
WO WO-2022250701 A1 * 12/2022 ..... E21B 33/129

OTHER PUBLICATIONS

International Search Report and Written Opinion in International Appln. No. PCT/US2024/053661, dated Jan. 22, 2025, 15 pages.
(Continued)

*Primary Examiner* — Cathleen R Hutchins
(74) *Attorney, Agent, or Firm* — Fish & Richardson P.C.

(57) ABSTRACT

A thru-tubing completion system includes a sub-surface completion unit (SCU) configured to pass through a production tubing disposed in a wellbore in at least an open holed portion of the wellbore and perform completion operations in the target zone. The SCU includes an expandable liner; and one or more SCU anchoring seals configured to be positioned in an un-deployed position and a deployed position. The un-deployed position of the one or more SCU anchoring seals enables the SCU to pass through the production tubing, and the deployed position of the one or more SCU anchoring seals provides a seal against a wall of the open holed portion of the wellbore to provide zonal isolation between regions in the wellbore. The one or more SCU anchoring seals includes a chemically active expandable metal configured to expand in the deployed position to provide the seal against the wall of the open holed portion of the wellbore.

22 Claims, 19 Drawing Sheets

(56) References Cited

U.S. PATENT DOCUMENTS

| | | | | |
|---|---|---|---|---|
| 10,570,696 | B2 | 2/2020 | Arsalan et al. | |
| 10,584,556 | B2 | 3/2020 | Arsalan et al. | |
| 10,634,553 | B1 | 4/2020 | Hveding et al. | |
| 10,655,429 | B2 | 5/2020 | Arsalan et al. | |
| 10,724,329 | B2 | 7/2020 | Arsalan et al. | |
| 10,767,452 | B2 | 9/2020 | Arsalan et al. | |
| 10,781,660 | B2 | 9/2020 | Arsalan et al. | |
| 10,880,007 | B1 | 12/2020 | Hveding et al. | |
| 10,907,442 | B2 | 2/2021 | Arsalan et al. | |
| 10,913,885 | B1 | 2/2021 | Fripp et al. | |
| 10,934,814 | B2 | 3/2021 | Arsalan et al. | |
| 10,962,408 | B2 | 3/2021 | Hveding et al. | |
| 11,028,667 | B2 | 6/2021 | Arsalan et al. | |
| 11,028,673 | B2 | 6/2021 | Arsalan et al. | |
| 11,060,382 | B2 | 7/2021 | Sherman | |
| 11,078,751 | B2 | 8/2021 | Arsalan et al. | |
| 11,156,059 | B2 | 10/2021 | Arsalan et al. | |
| 11,242,731 | B2 | 2/2022 | Arsalan et al. | |
| 11,268,342 | B2 * | 3/2022 | Andersen | E21B 33/1216 |
| 11,339,636 | B2 | 5/2022 | Arsalan et al. | |
| 11,359,448 | B2 | 6/2022 | Fripp et al. | |
| 11,519,767 | B2 | 12/2022 | Mahalingam et al. | |
| 11,644,351 | B2 | 5/2023 | Karimi et al. | |
| 11,698,288 | B2 | 7/2023 | Hveding et al. | |
| 11,920,424 | B2 | 3/2024 | Arsalan et al. | |
| 11,920,469 | B2 | 3/2024 | Mahalingam et al. | |
| 12,019,200 | B2 | 6/2024 | Hveding et al. | |
| 12,085,687 | B2 | 9/2024 | Lin et al. | |
| 2010/0319928 | A1 | 12/2010 | Bussear et al. | |
| 2011/0192596 | A1 | 8/2011 | Patel | |
| 2018/0038193 | A1 * | 2/2018 | Walton | E21B 23/06 |
| 2020/0325749 | A1 | 10/2020 | Fripp et al. | |
| 2021/0189830 | A1 * | 6/2021 | Greci | E21B 43/103 |
| 2021/0222510 | A1 | 7/2021 | Fripp et al. | |
| 2021/0332659 | A1 | 10/2021 | Fripp et al. | |
| 2021/0332673 | A1 | 10/2021 | Fripp et al. | |
| 2023/0142742 | A1 | 5/2023 | Lin et al. | |
| 2024/0167352 | A1 | 5/2024 | Arsalan et al. | |

OTHER PUBLICATIONS

U.S. Appl. No. 18/581,986, filed Feb. 20, 2024, Ramakrishnan et al.

U.S. Appl. No. 18/584,700, filed Feb. 22, 2024, Purusharthy et al.

[No Author Listed], "Halliburton Launches Advanced Material Science Completions Technology," Halliburton, Apr. 14, 2021, 2 pages.

concretecanvas.com [online], "Concrete Canvas," Available on or before Aug. 1, 2021, via Internet Archive: Wayback Machine URL <https://web.archive.org/web/20210801204605/https://www.concretecanvas.com/us/concretecanvas/#toggle-id-1>, retrieved on Nov. 8, 2024, via URL <https://www.concretecanvas.com/us/concretecanvas/#toggle-id-1>, 9 pages.

Kelsey et al., "Multilateral Expandable Metal Anchoring Packer Design, Development, and Application in the North Sea," Prepared for presentation at the Offshore Technology Conference originally scheduled to be held in Houston, TX, USA, May 4-7, 2020, 10 pages.

Ovidius® Expanding Isolation System, Halliburton Brochure, Available on or before Apr. 13, 2021, 2 pages.

* cited by examiner

SYSTEMS AND METHODS FOR ANCHORING A SUB-SURFACE COMPLETION UNIT IN A WELLBORE

CROSS-REFERENCE TO RELATED APPLICATION

This application claims priority under 35 U.S.C. § 119 to U.S. Provisional Patent Application Ser. No. 63/594,761, filed on Oct. 31, 2023, the entire contents of which are incorporated by reference herein.

TECHNICAL FIELD

This disclosure relates to systems and methods for anchoring a sub-surface completion unit (SCU) in a wellbore.

BACKGROUND

Sub-surface completion units (SCUs) often use anchoring seals in combination with inflatable bag elements filled with cement or setting materials. However, this requires a means to inject cement from the surface or a downhole sump to achieve inflation, which includes operational risks. Other methods of anchoring seals include the use of flat layers of concrete sheets that can be placed in a configuration that can expand radially or axially after reaction. However, the challenge in this situation includes stacking enough material in a form to provide for extreme expansion of an outer diameter when configured in an initial state of a cylindrical form factor.

SUMMARY

In an example implementation, a thru-tubing completion system includes a sub-surface completion unit (SCU) configured to pass through a production tubing disposed in a wellbore in at least an open holed portion of the wellbore and perform completion operations in the target zone. The SCU includes an expandable liner; and one or more SCU anchoring seals configured to be positioned in an un-deployed position and a deployed position. The un-deployed position of the one or more SCU anchoring seals enables the SCU to pass through the production tubing, and the deployed position of the one or more SCU anchoring seals provides a seal against a wall of the open holed portion of the wellbore to provide zonal isolation between regions in the wellbore. The one or more SCU anchoring seals includes a chemically active expandable metal configured to expand in the deployed position to provide the seal against the wall of the open holed portion of the wellbore.

In an aspect combinable with the example implementation, the SCU includes an enclosure configured to carry the chemically active expandable metal on the expandable liner in the un-deployed position.

In another aspect combinable with any of the previous aspects, the expandable liner includes a groove formed on an outer surface.

In another aspect combinable with any of the previous aspects, the enclosure is positioned in the groove in the undeployed positioned.

In another aspect combinable with any of the previous aspects, the enclosure includes an expandable mesh or porous bag configured to expand during a transition between the un-deployed positioned and the deployed position while enclosing the chemically active expandable metal.

In another aspect combinable with any of the previous aspects, the chemically active expandable metal includes a granular metal, a powder metal, metal wires, spherical or oval metal members, nodular metal members, metal pellets, or metal bars with different cross section shapes.

In another aspect combinable with any of the previous aspects, the chemically active expandable metal includes a metal alkaline, a transition metal, or a post-transition metal.

In another aspect combinable with any of the previous aspects, the chemically active expandable metal is configured to expand in contact with one or more wellbore fluids in a hydration reaction in the wellbore.

In another aspect combinable with any of the previous aspects, the SCU further includes one or more swellable elements positioned on the expandable liner adjacent the one or more SCU anchoring seals.

In another aspect combinable with any of the previous aspects, the one or more swellable elements is coupled to the expandable liner with breakable elastic member.

In another aspect combinable with any of the previous aspects, the one or more swellable elements acts as a sealing ring at an axial end of the chemically active expandable metal.

In another aspect combinable with any of the previous aspects, the chemically active expandable metal is formed as a scroll mesh that is furled in the un-deployed position and unfurled in the deployed position.

In another aspect combinable with any of the previous aspects, the scroll mesh includes a plurality of layers that include the chemically reactive expandable metal.

In another example implementation, a method of sealing a wellbore includes running a sub-surface completion unit (SCU) through a production tubing disposed in a wellbore to at least an open holed portion of the wellbore and perform completion operations in the target zone. The SCU includes an expandable liner; and one or more SCU anchoring seals in an un-deployed position to enable the SCU to pass through the production tubing. The one or more SCU anchoring seals includes a chemically active expandable metal. The method includes activating the one or more SCU anchoring seals from the un-deployed position to a deployed position by expanding the chemically active expandable metal; and sealing the expandable liner against a wall of the open holed portion of the wellbore to provide zonal isolation between regions in the wellbore with the one or more SCU anchoring seals in the deployed position.

In an aspect combinable with the example implementation, the SCU includes an enclosure configured to carry the chemically active expandable metal on the expandable liner in the un-deployed position.

In another aspect combinable with any of the previous aspects, the expandable liner includes a groove formed on an outer surface, and the enclosure is positioned in the groove in the undeployed positioned.

In another aspect combinable with any of the previous aspects, the enclosure includes an expandable mesh or porous bag configured to expand during a transition between the un-deployed positioned and the deployed position while enclosing the chemically active expandable metal.

In another aspect combinable with any of the previous aspects, the chemically active expandable metal includes a granular metal, a powder metal, metal wires, spherical or oval metal members, nodular metal members, metal pellets, or metal bars with different cross section shapes.

In another aspect combinable with any of the previous aspects, the chemically active expandable metal includes a metal alkaline, a transition metal, or a post-transition metal.

In another aspect combinable with any of the previous aspects, the chemically active expandable metal expands in contact with one or more wellbore fluids in a hydration reaction in the wellbore.

In another aspect combinable with any of the previous aspects, the SCU further includes one or more swellable elements positioned on the expandable liner adjacent the one or more SCU anchoring seals.

In another aspect combinable with any of the previous aspects, the one or more swellable elements is coupled to the expandable liner with breakable elastic member.

In another aspect combinable with any of the previous aspects, the one or more swellable elements acts as a sealing ring at an axial end of the chemically active expandable metal.

In another aspect combinable with any of the previous aspects, the chemically active expandable metal is formed as a scroll mesh that is furled in the un-deployed position and unfurled in the deployed position.

In another aspect combinable with any of the previous aspects, the scroll mesh includes a plurality of layers that include the chemically reactive expandable metal.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1A:
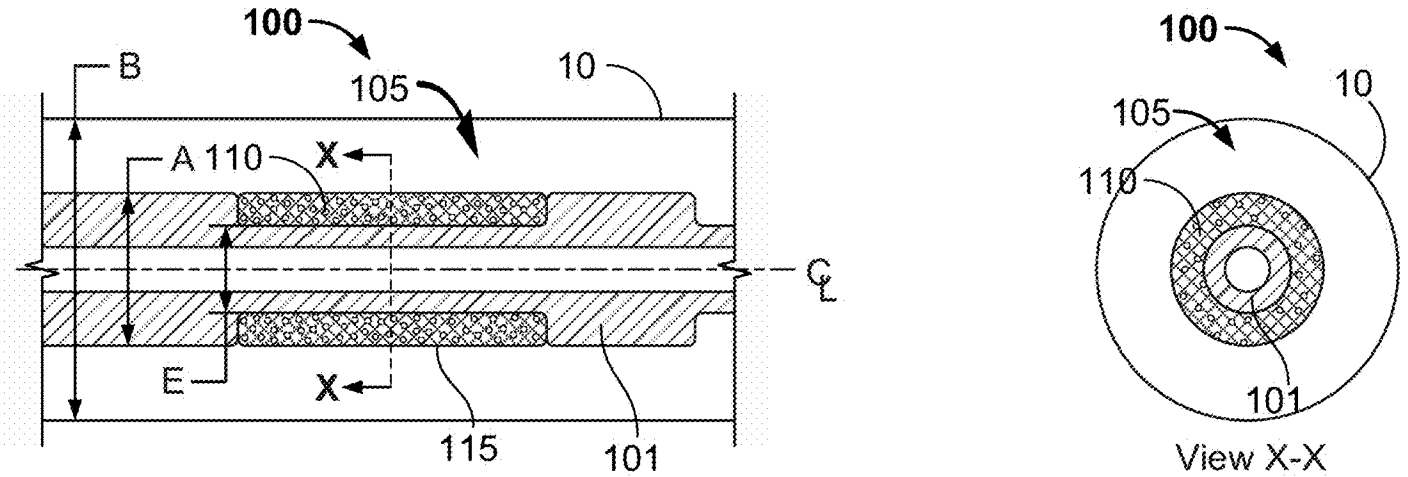
FIGS. 1A-1E are schematic illustrations of an example implementation of an anchoring system for an expandable liner and process of using same according to the present disclosure.

The present disclosure describes systems and methods of anchoring a sub-surface completion unit (SCU) when operating a well using a thru-tubing completion system (TTCS). In some embodiments, a TTCS includes one or more SCUs that are deployed down-hole, in a wellbore having a production tubing string in place. For example, an SCU can be delivered through the production tubing to a target zone of the wellbore in need of completion, such as an open holed portion of the wellbore that is down-hole from a down-hole end of the production tubing and that is experiencing breakthrough. In some embodiments, a deployed SCU is operated to provide completion of an associated target zone of the wellbore. For example, seals and valves of a deployed SCU can be operated to provide providing zonal fluid isolation of annular regions of the well bore located around the SCU, to control the flow of breakthrough fluids into a stream of production fluids flowing up the wellbore and the production tubing.

Embodiments of an SCU with anchoring seals according to the present disclosure are installed in a wellbore formed into a hydrocarbon reservoir located in a subsurface formation. The formation can include a porous or fractured rock formation that resides underground, beneath a terranean surface. In the case of the wellbore being a hydrocarbon well, the reservoir can include a portion of the formation that contains (or that is determined to or expected to contain) a subsurface pool of hydrocarbons, such as oil and gas. The formation and the reservoir can each include different layers of rock having varying characteristics, such as varying degrees of permeability, porosity, and resistivity. In the case of the well system being operated as a production well, the well system can facilitate the extraction of hydrocarbons (or "production") from the reservoir. In the case of the well system being operated as an injection well, the well system can facilitate the injection of fluids, such as water, into the reservoir. In the case of the well being operated as a monitoring well, the well system can facilitate the monitoring of characteristics of the reservoir, such reservoir pressure or water encroachment.

In some embodiments, an SCU is advanced through a production tubing in an un-deployed configuration. In an un-deployed configuration, one or more expandable elements of the SCU, such as centralizers and anchoring seals, are provided in a retracted (or "un-deployed") position. In an un-deployed configuration, the overall size of the SCU can be relatively small in comparison to an overall size of the SCU in a deployed configuration (which can include the one or more expandable elements of the SCU provided in an extended (or "deployed") position). The un-deployed configuration can enable the SCU to pass through the internal passage of the production tubing, and a smallest cross-section of an intervening portion of the wellbore between the down-hole end of the production tubing and a target zone.

In a deployed configuration of an SCU, one or more expandable elements of the SCU, such as centralizers and anchoring seals, are provided in an extended (or "deployed") position to facilitate to provide completion operations, such as the SCU sealing off at least a portion of a target zone. For example, an SCU can have positioning devices, such as centralizers that are expanded radially outwardly into a deployed configuration to center the SCU in the wellbore, and anchoring seals (as described herein) that are expanded radially outwardly to engage and seal against a wall of the wellbore located about the SCU. Generally, an anchoring seal can include a sealing member, that is expanded radially to provide a fluid seal between an exterior of a body of the SCU and the wall of the wellbore. This can provide fluid seal between regions on opposite sides of the sealing member, and in effect provide "zonal fluid isolation" between regions on opposite sides of the sealing member.

FIGS. 1A-1E are schematic illustrations of an example implementation of an anchoring system for an expandable liner and process of using same according to the present disclosure. In this example implementation, the anchoring system 100 comprises an expandable liner 105 (on a portion of an SCU 101) with a connected conformal encapsulated chemically active expandable metal 110 in a solid geometrical form. In the example of FIGS. 1A-1E, the anchoring system 100 combines an expandable liner 105 with the reactive metal 110 that can, e.g., be carried in a mesh or a porous bag 115 connected to the outer diameter of the expandable liner 105 (e.g., preferably in a groove 120 such that the maximum diameter of the assembly is the same as the expandable liner run-in-hole diameter). The mesh or porous bag 115 can be made with metal or nonmetal, dissolvable or stretchable materials. In some aspects, the mesh or porous bag 115 can be detachable to allow pull out of the unit while leaving the detachable anchoring seal in the open hole.

This mesh or porous bag 115 can be designed with pore sizes that can physically retain the reactive metal raw material 110 from before, during, and after the expansion of the liner 105. In some aspects, the mesh or porous bag 115 is elastic and has spring like properties such that the mesh or porous bag 115 grows to accommodate the radial growth of the expandable liner 105 over which it is connected. At the same time, the carried reactive metal raw material 110 is adjusted to conform to the decreasing volume in the carrier bag 115. This is achieved at least in part because the reactive metal raw material 110 is conformal and allows for three-dimensional relative motion between two individual entities. Some forms of the raw material 110 that allow this are, for example, granular, powder, wires, spherical or oval, nodular, pellet, bars with different cross section shapes etc. The mesh or porous bag 115 can be made from any material that has the required mechanical and physical properties. This can be made with metals and metallic alloys, spring wire, rubber, non-metallics, composites. One example can be an elastomeric bag with oriented or random pores. Another example can be a metal wire mesh with spring properties.

In some aspects, the size of each raw material 110 is sized to be bigger than the largest pore size anticipated at full expansion of the encapsulation. The final expanded configuration of the mesh or porous bag 115 can be predesigned through volume calculations such that the final structure is dense and compact.

In some aspects, the reactive metal raw material 110 can be an alkaline, transition metal or post-transition metal group that is susceptible to hydration reaction when exposed to water. For example, hydroxides increase volume and occupy more space than the base material based on molar mass comparisons. Once formed, the hydroxides have low solubility in water. The reaction parameters can be controlled by alloying and combinations of the metals from the stated group, mixing various binders and dopants.

The anchoring seal embodiment of FIGS. 1A-1E achieves the sealing and anchoring through the stages shown in these figures. For example, FIG. 1A shows a run-in-hole configuration of the anchoring seal 100 with a maximum outer diameter "A" positioned across an open hole wellbore 10 (e.g., an open hole completion) with an internal diameter "B." The expandable liner groove 120 outer diameter is shown as "E."

Figure 1B:
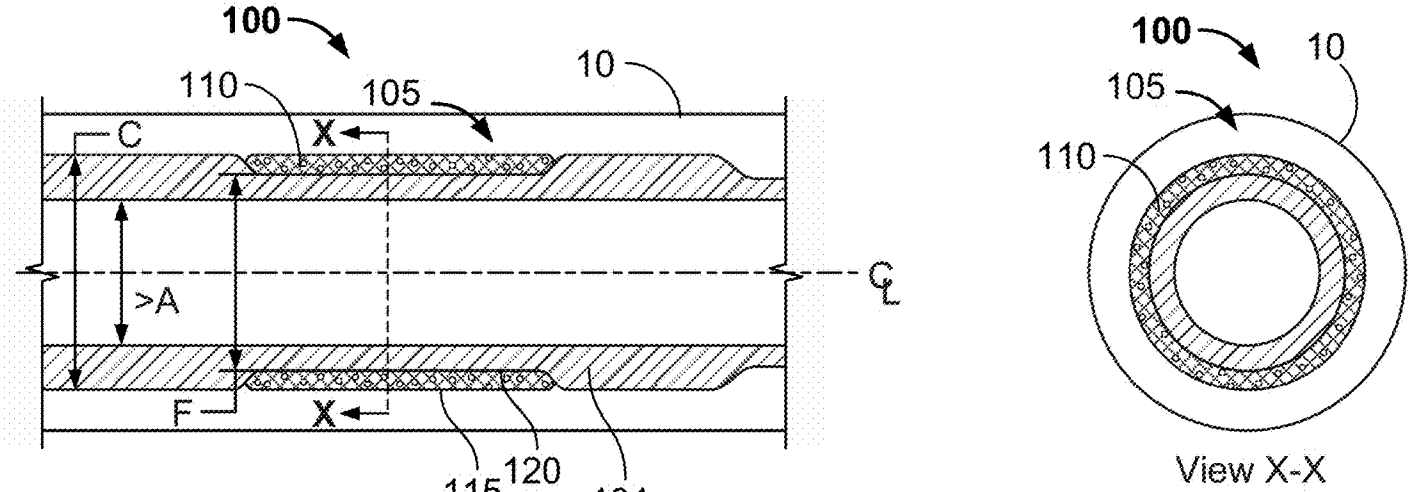

FIG. 1B shows the expanded liner position such that the internal diameter is greater than "A" and the outer diameter is "C" (where C>A but C<B). The new expanded liner groove diameter is "F."

Figure 1C:
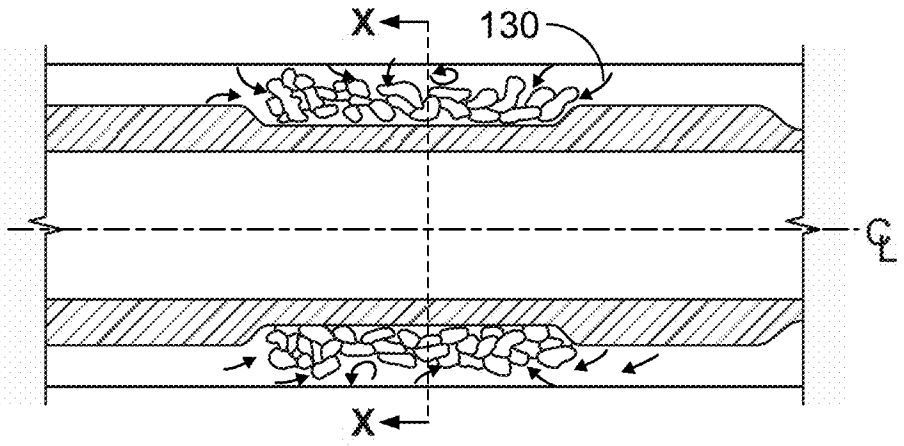
Figure 1C:
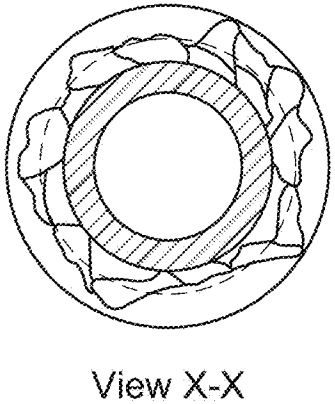

FIG. 1C shows the reaction progression. For example, the reactive metal raw material 110 is exposed to well fluids 130 that include water or brine. This exposure starts a chemical reaction (or reactions), which produce reactants having more volume than the raw material 110.

Figure 1D:
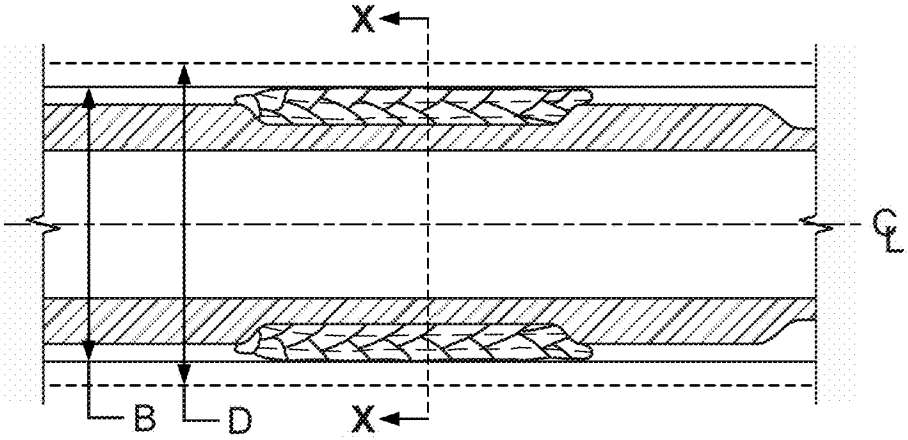
Figure 1D:
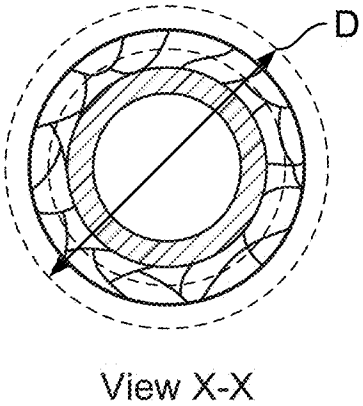

FIG. 1D shows the anchoring seal 100 in an expanded position. As shown, the reactive metal 110 grows radially till it is constrained by the open hole internal diameter "C" and the expanded liner groove outer diameter "F." A sealing and anchoring force is generated at an interface through a cumulative volume increase of reactants, conglomeration and adhesion among reactant entities to form a unitized structure. The remnants of the mesh bag 115 can act as reinforcement to the unitized structure as the conglomerates grow around and through the mesh or porous bag 115. The conformal nature of the conglomerate growth achieves a seal even against ovalities and cracks in the open hole 10 as the reactants tend to fill any available gaps. A hypothetical diameter "D" (such that D>C) indicates that the volume from the reactants can occupy a much larger diameter should there have been no restriction from the open hole. This is how a state of interference is created to generate a high interface pressure for a robust seal and anchoring force.

Figure 1E:
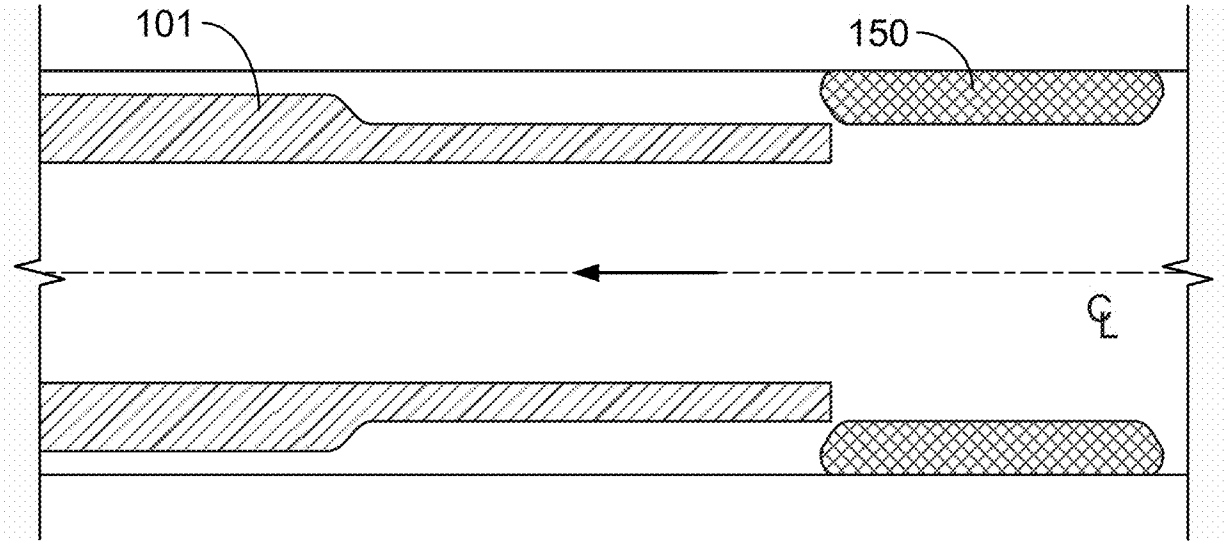

FIG. 1E shows an optional release during a pull-out-of-hole operations. As shown, the detachable unitized reactant structure 150 is left in the open hole wellbore 10. The reactant structure 150 can collapse and fall in the well 10 due to removal of a supporting liner from below.

FIGS. 2A-2F are schematic illustrations of another example implementation of an anchoring system 200 for an expandable liner and process of using same according to the present disclosure. In the example of FIGS. 2A-2F, the anchoring system 200 combines an expandable liner 205 (on groove 220 of an SCU 201) with connected conformal encapsulated chemically active expandable metal 210 in solid geometrical form, which is combined with unfurling swellable elastomers 212 (that act as end rings 212) for sealing and extrusion support. The embodiment shown in FIGS. 2A-2F builds on the embodiment shown in FIGS. 1A-1E by additionally including unfurling thin swellable elements 212 that swell in a final state and act as secondary sealing and support anti-extrusion end rings 212 for the primary sealing and anchoring unitized reactive metal conglomerate reactant structure. These swellable elements can be designed such that the perimeter/circumference sits flush or close to flush with some interference with the expanded groove outer diameter.

Figure 3A:
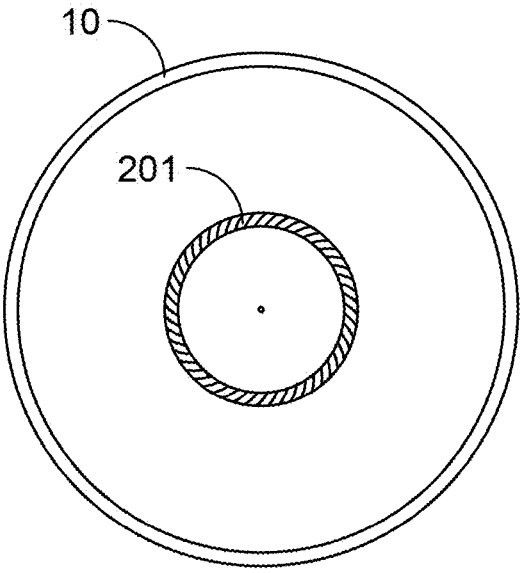
FIGS. 3A-3C are schematic illustrations of a swell element and process of using same according to the present disclosure.
Figure 3B:
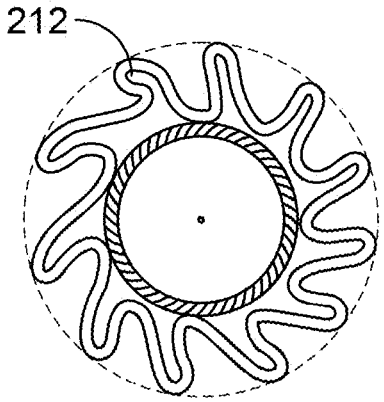
Figure 3C:
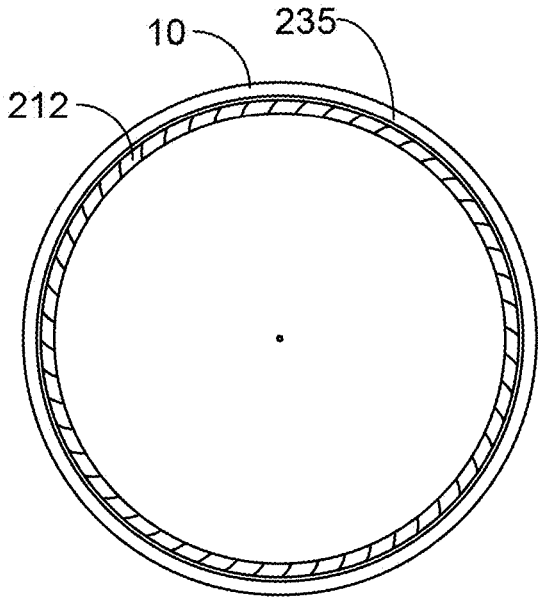

At installation, the additional circumference of initial swell element is reduced by creating radial furls that are folded onto each other and kept in place through a temporary external clastic contraption such as elastic tube or band. This is illustrated in FIGS. 3A-3C. FIG. 3A shows the initial, unfurled element 212. As the liner is expanded, this temporary contraction breaks or dissolves allowing for the unfurling of the swellable elastomer 212 (shown in FIG. 3B) that gradually conforms to the final groove outer diameter of the expanded liner creating an initial seal at this interface 235 as shown in FIG. 3C.

While the reactive metal 210 energizes through reaction with well fluids 230, the swellable elastomer also swells and engages with the open hole diameter to create a conformal seal and reinforces the seal with the expanded liner groove interface. By nature, the swellable elastomer is a single entity in an initial state and therefore acts as solid end rings 212 at each axial end forming sealing and extrusion support to the unitized reactive metal conglomerate reactant structure.

The embodiment of FIGS. 2A-2E achieves the sealing and anchoring through the stages show in these figures, which show only half cross-sections and just the element section for simplicity (noting that FIGS. 1A-1E largely already represents the operation sequence).

Figure 2A:
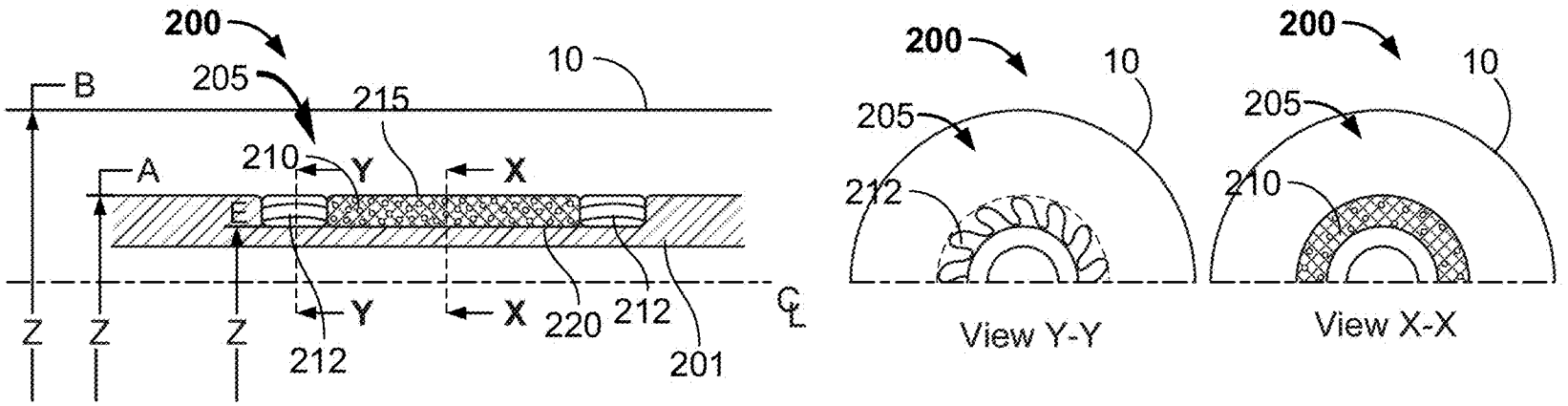
FIGS. 2A-2F are schematic illustrations of another example implementation of an anchoring system for an expandable liner and process of using same according to the present disclosure.

FIG. 2A shows a run-in-hole operation and configuration with a maximum outer diameter "A" positioned across the open hole wellbore 10 with the internal diameter "B" and the expandable liner groove outer diameter "E" for both swellable elastomer and the reactive metal containment.

Figure 2B:
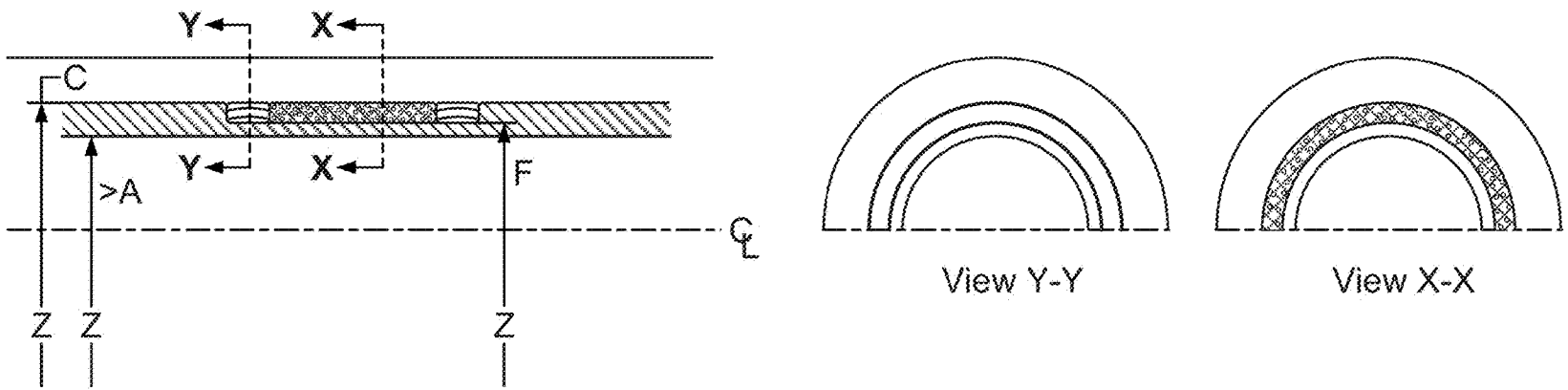

FIG. 2B shows the expanded liner position such that the internal diameter is greater than "A" and the outer diameter is "C" (where C>A but C<B). The new expanded liner groove diameter is "F." An initial seal is formed at liner surface by swell elements 212 through unfurling and interference.

Figure 2C:
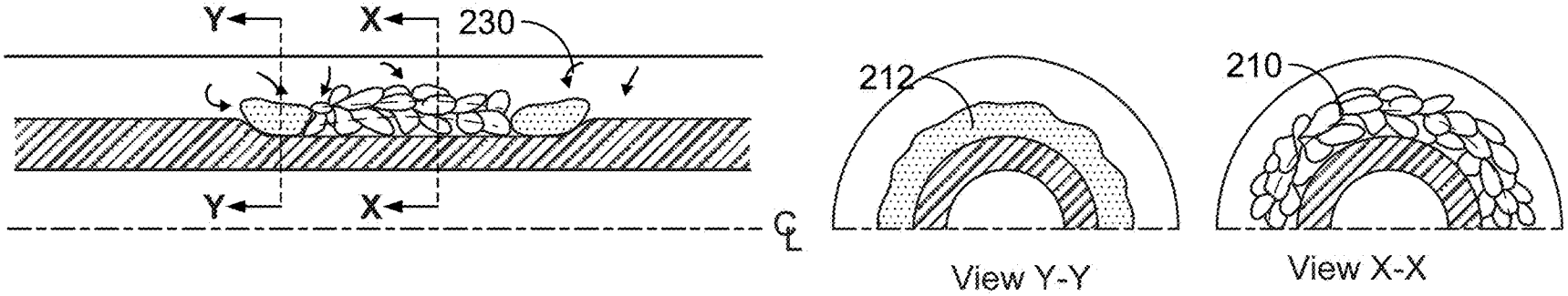

FIG. 2C shows a reaction progression where the reactive metal raw material 210 is exposed to the well fluids 230 that include water or brine. This exposure starts the chemical reactions, which produce reactants having more volume than the raw material. Swell elements 212 are exposed to the well fluids 230 starting the swell reaction.

Figure 2D:
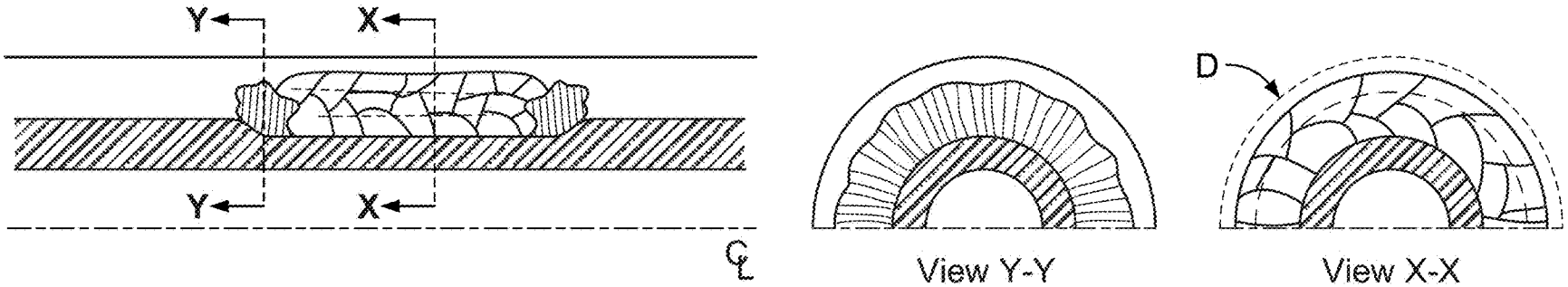

FIG. 2D shows the anchoring seal 200 in an expanded position, where the reactive metal 210 grows radially till it is constrained by the open hole internal diameter "C" and the expanded liner groove outer diameter "F." A sealing and anchoring force is generated at the interface through cumulative volume increase of reactants, conglomeration and adhesion among reactant entities to form a unitized structure. The remnants of the mesh bag 215 act as reinforcement to the unitized structure as the conglomerates grow around and through the mesh or porous bag 215. The conformal nature of the conglomerate growth achieves a seal even against ovalities and cracks in the open hole 10 as the reactants tend to fill any available gaps. A hypothetical diameter "D" (such that D>C) indicates that the volume from the reactants would occupy a much larger diameter should there have been no restriction from the open hole wellbore. This is how a state of interference is created generating high interface pressure for a robust seal and anchoring force.

Figure 2E:
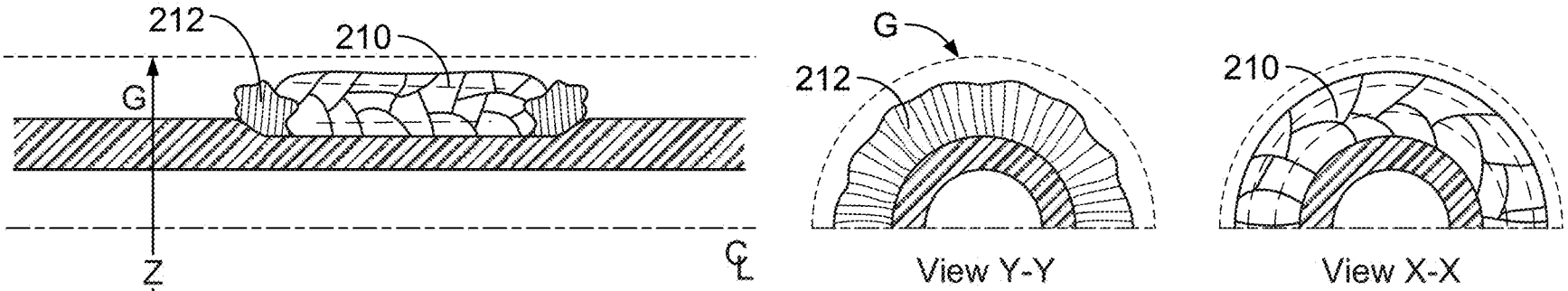

FIG. 2E shows that the swell elastomers 212 attain radial contact with the open hole internal diameter "C" and increase seal at the expanded liner groove outer diameter "F." A hypothetical diameter "G" (such that G>C) indicates that the volume from the swollen elastomer 212 would occupy a much larger diameter should there have been no restriction from the open hole 10. This is how a state of interference is created generating high interface pressure for a robust seal and anti-extrusion resistance for the contained reactive metal conglomerate.

Figure 2F:
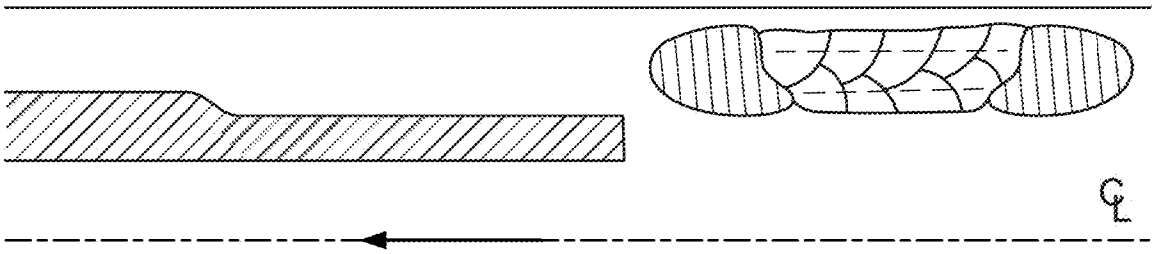

FIG. 2F shows an optional release during a pull-out-of-hole operation that leaves the detachable unitized reactant structure 250 with swell elastomers 212 in hole 10. The reactant structure 250 is still held in place by the swell element end rings 212.

FIGS. 4A-4E are schematic illustrations of another example implementation of an anchoring system 400 for an expandable liner 405 and process of using same according to the present disclosure. In the example of FIGS. 4A-4E, the anchoring system 400 combines an expandable liner 405 (on a portion of an SCU 401) with a connected conformal and layered encapsulated chemically active expandable metal 410 in solid geometrical form within a scroll mesh 415 for secondary radial expansion. The embodiment of FIGS. 4A-4E involves combining an expandable liner 405 with the reactive metal 410 that will be carried in a scroll mesh 415 captured inside a porous bag or mesh 417 connected to the outer diameter of the expandable liner 405 (e.g., preferably in a groove 420 such that the maximum diameter of the assembly is the same as the expandable liner run-in-hole diameter) with the scroll mesh 415 anchored in the fully tightened condition.

Figure 5:
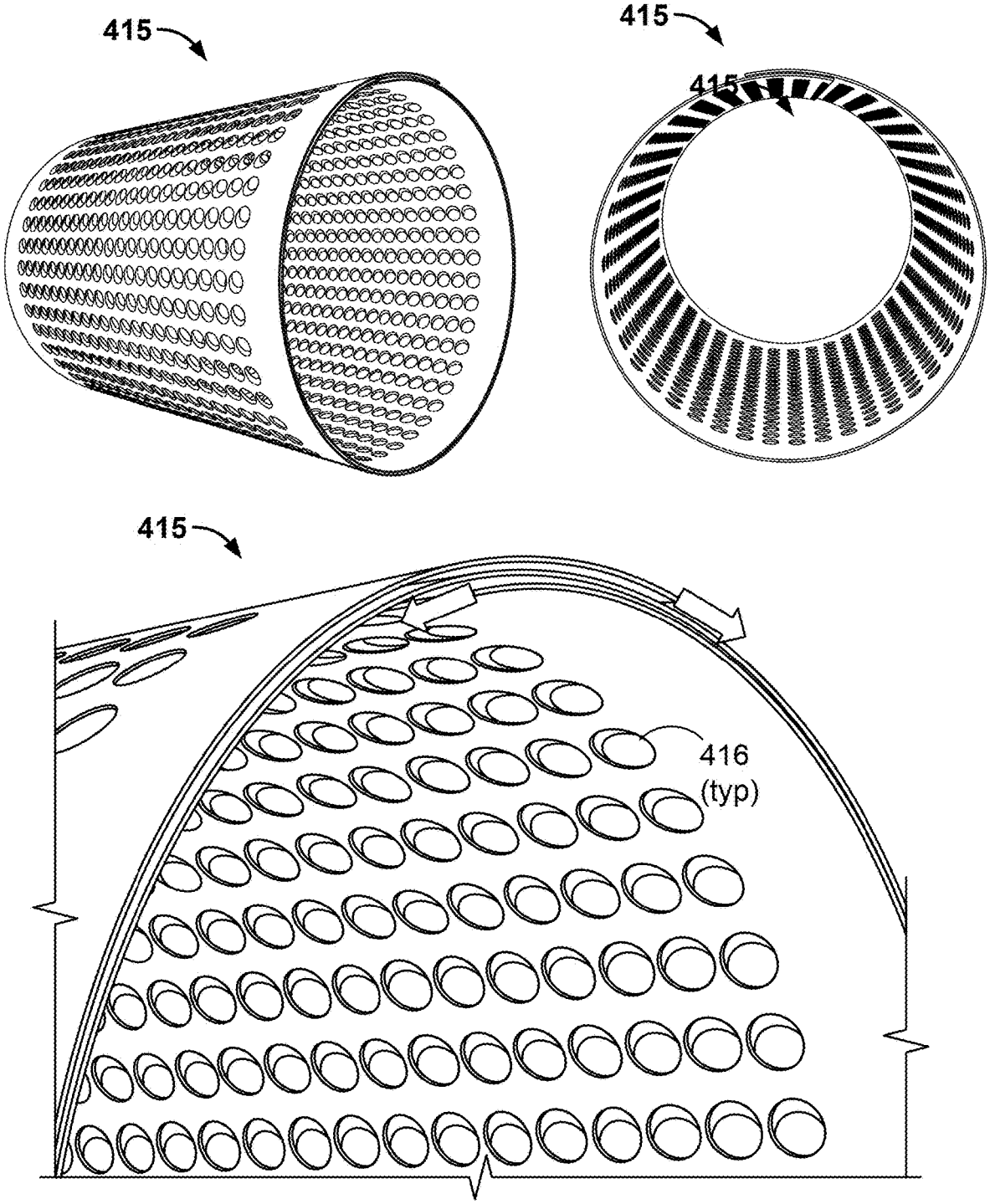
FIG. 5 are views of a scroll mesh that can be used in an anchoring system for an expandable liner according to the present disclosure.

An example of the scroll mesh 415 is shown in FIG. 5. Tightening the scroll mesh 415 in the directions shown in FIG. 5 allows for reducing the external and internal diameters of the scroll mesh such that it can be made to sit flush against the expandable liner groove 420. Doing so increases the spring force in the scroll mesh 415. The outer encapsulating mesh or porous bag 417 can be made with metal or nonmetal, dissolvable or stretchable materials (e.g., such as described with reference to FIGS. 1A-1E). This is also in some configurations made to be detachable to allow pull out of the unit while leaving the detachable anchoring seal in the open hole.

As shown in FIG. 5, the scroll mesh 415 can be designed with a plurality of holes 416 that can allow movement of the reactive metal raw material 410 through the layers. The scroll mesh 415 can further be deployed during the expandable liner expansion process. The spring force within the tightened scroll 415 is released to cause unscrolling/unwinding of the scroll mesh 415 once a pinning method to groove is breached. This external mesh or porous bag 417 is designed with pore sizes that can physically retain the reactive metal raw material 410 before, during and after the expansion of the liner 405 and the scroll mesh 415. This is achieved by using a mesh or porous bag 417 that is elastic and has spring like properties such that the mesh or porous bag 417 grows to accommodate the radial growth of the expandable liner section over which it is connected.

At the same time, the carried reactive metal raw material form is adjusted to conform to the new volume in the space and gaps between the scroll mesh the liner groove OD. This is possible because the reactive metal raw material form is conformal and allows for three dimensional relative motion between two individual entities, including movement through the holes of the scroll mesh. Some of the raw material forms that allow this can be, e.g., granular, powder, wires, spherical or oval, nodular, pellet, bars with different cross section shapes etc. The mesh or porous bag can be made from any material that has the required mechanical and physical properties. This can be made with metals and metallic alloys, spring wire, rubber, non-metallics, composites. One example can be an elastomeric bag with oriented or random pores. Another example can be a metal wire mesh with spring properties.

In some aspects, the size of each raw material 410 is sized to be bigger than the largest pore size anticipated at full expansion of the encapsulation mesh 417. The final expanded configuration of the external mesh or porous bag 417 can be predesigned through volume calculations such that the final structure is dense and compact. At the same time, the holes 416 on the scroll mesh 415 are designed to be bigger than the largest raw material entity to allow for free movement within the interstices of the combined structure.

In some aspects, the reactive metal raw material 410 can be, e.g., alkaline, transition metal or post-transition metal group that is susceptible to hydration reaction when exposed to water. For example, hydroxides increase volume and occupy more space than the base material based on molar mass comparisons. Once formed, the hydroxides have low solubility in water. The reaction parameters can be controlled by alloying and combinations of the metals from the stated group, mixing various binders and dopants.

Figure 4A:
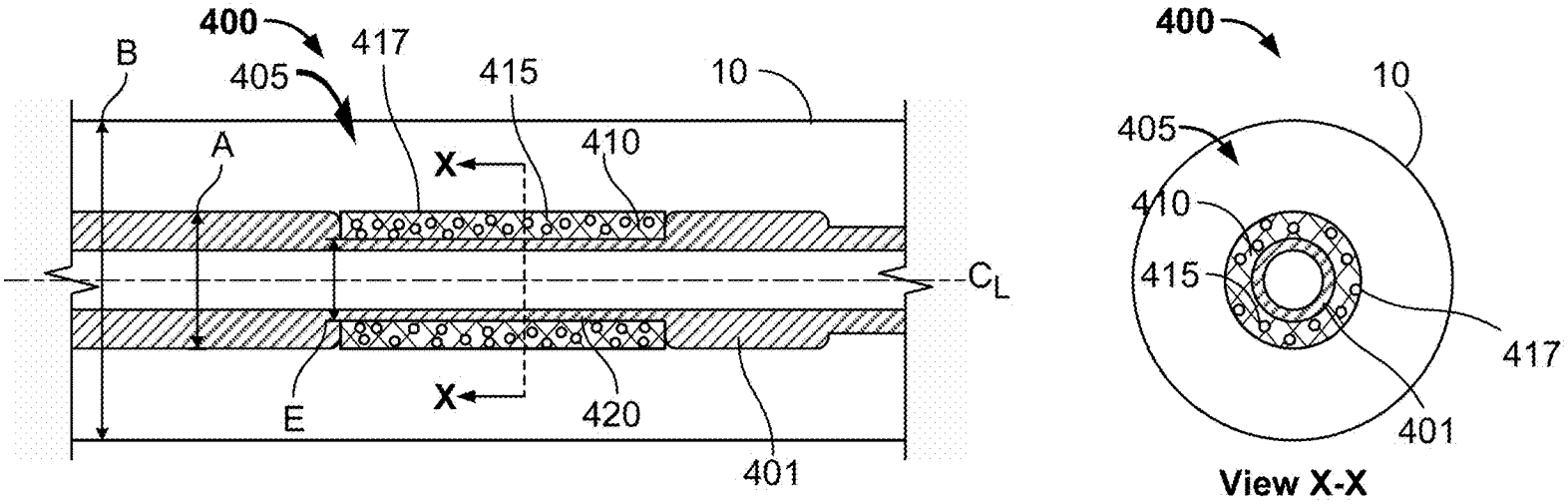
FIGS. 4A-4E are schematic illustrations of another example implementation of an anchoring system for an expandable liner and process of using same according to the present disclosure.

The embodiment of FIGS. 4A-4E achieves the scaling and anchoring through the stages show in these figures. FIG. 4A shows a run-in-hole configuration with a maximum outer diameter "A" positioned across the open hole wellbore 10 with internal diameter "B." The expandable liner groove 420 has an outer diameter "E."

Figure 4B:
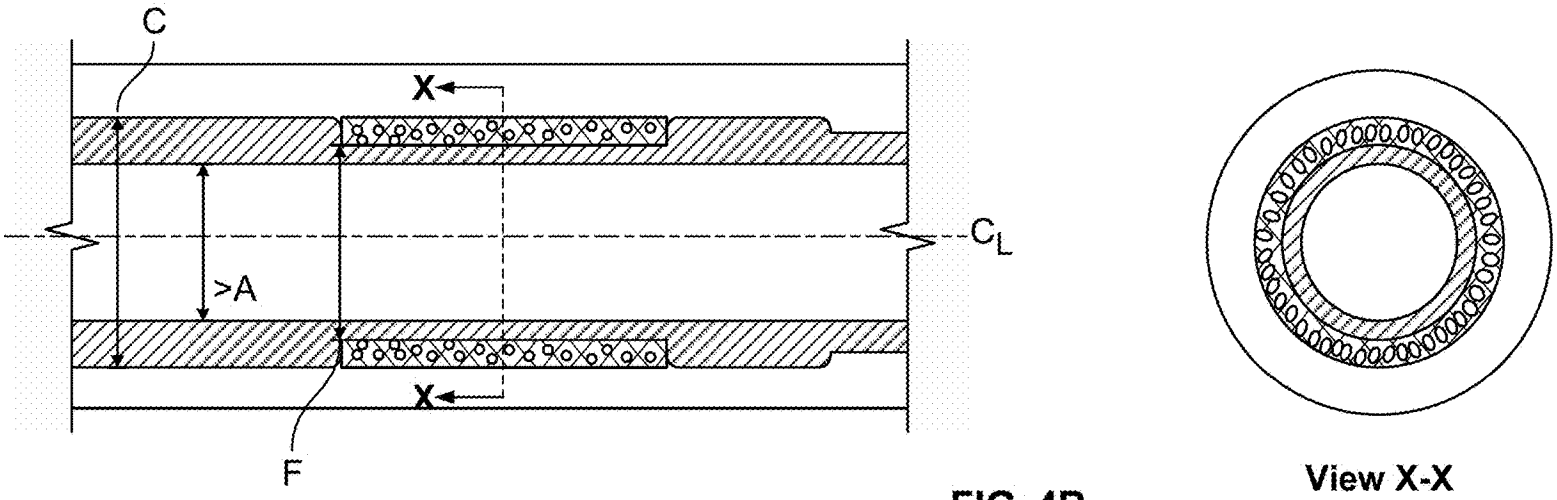
Figure 4C:
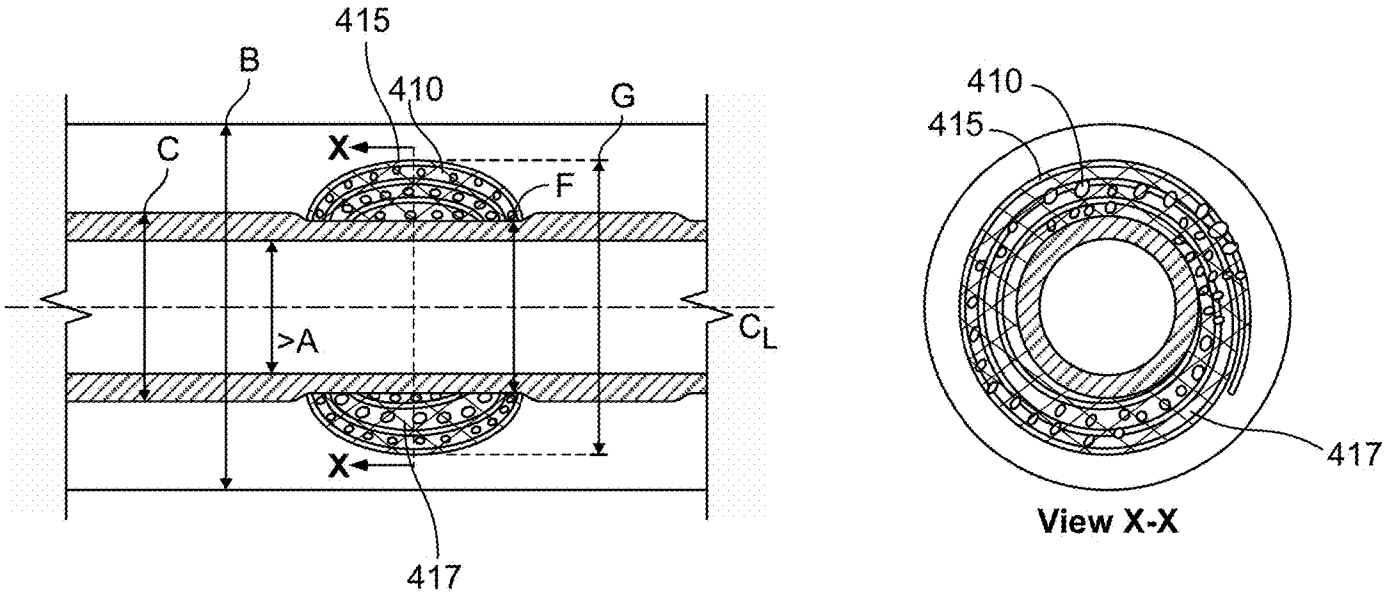

FIG. 4B shows the expanded liner position such that the internal diameter is greater than "A" and outer diameter is "C" (where C>A but C<B). The new expanded liner groove diameter is "F." During this step in the process, the scroll mesh 415 is deployed by breaking of a pinning/locking mechanism and the stored spring force unscrolling/unwinding the scroll to a diameter G<B (with G>C) as shown in FIG. 4C. This allows the reactive raw material 410 to move through the interstices of the combined structure and closer to the open hole wellbore diameter. This completes the secondary expansion objective.

Figure 4D:
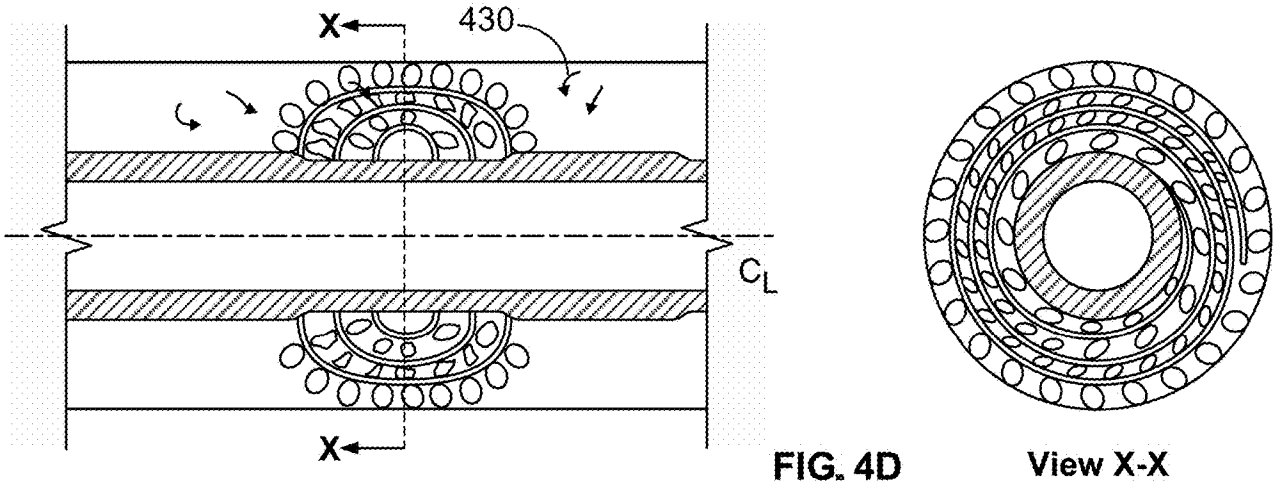

FIG. 4D shows the reaction progression where the reactive metal raw material 410 is exposed to well fluids 430 that include water or brine to start the chemical reactions which produce reactants having more volume than the raw material.

Figure 4E:
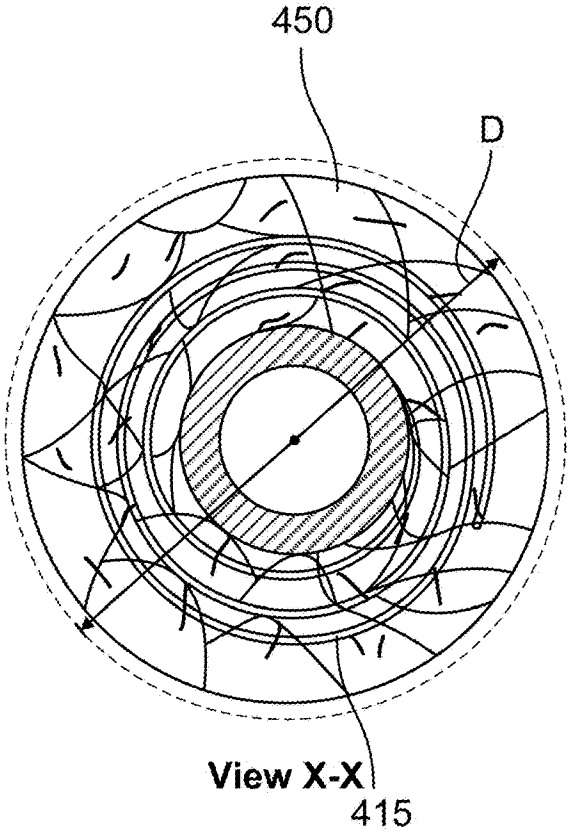
Figure 4E:
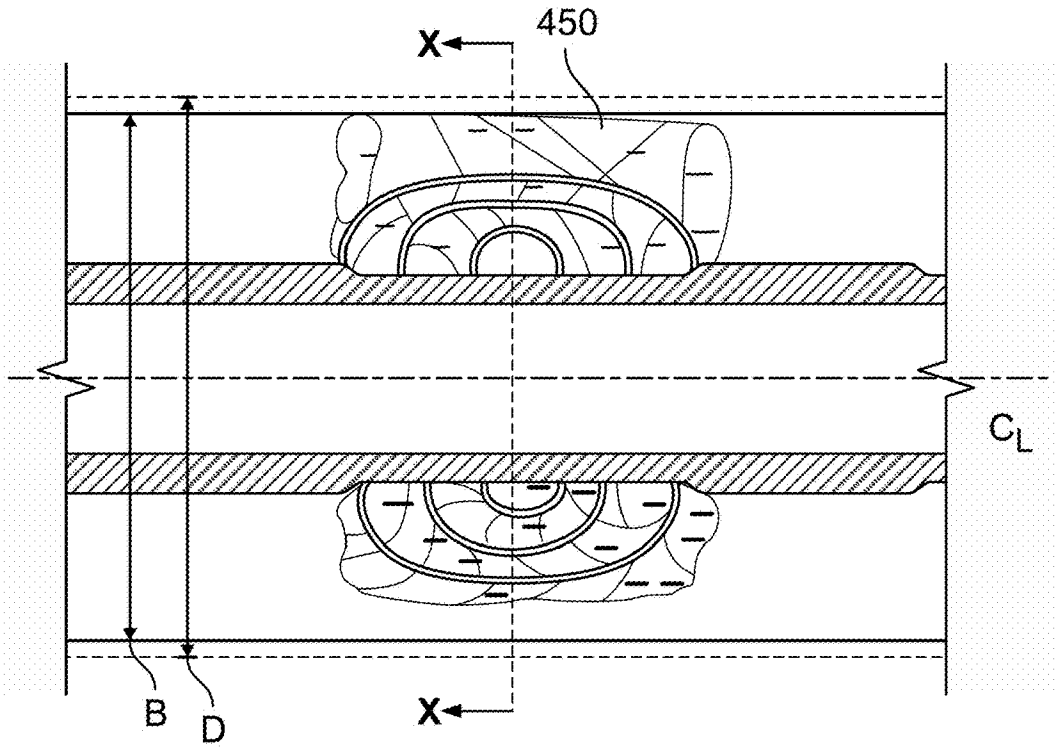

FIG. 4E shows that in the expanded position, reactive metal 410 grows radially until it is constrained by the open hole internal diameter "C" and the expanded liner groove outer diameter "F." A scaling and anchoring force is generated at the interface through cumulative volume increase of reactants, conglomeration and adhesion among reactant entities forming a unitized structure 450. The scroll mesh 415 with holes 416 acts as a strengthening skeleton while the remnants of the external mesh bag 417 act as reinforcement to the unitized structure 450 as the conglomerates grow around and through the scroll mesh 415, and external mesh or porous bag 417. The conformal nature of the conglomerate growth achieves a seal even against ovalities and cracks in the open hole 10 as the reactants tend to fill any available gaps. A hypothetical diameter "D" (such that D>C) indicates that the volume from the reactants would occupy a much larger diameter should there have been no restriction from the open hole 10. This is how a state of interference is created generating high interface pressure for a robust seal and anchoring force.

Although not shown here, as with the other embodiments, an optional release during a pull-out-of-hole can leave the detachable unitized reactant structure 450 in hole. The reactant structure 450 collapses and falls in the well due to removal of a supporting liner from below.

Figure 6A:
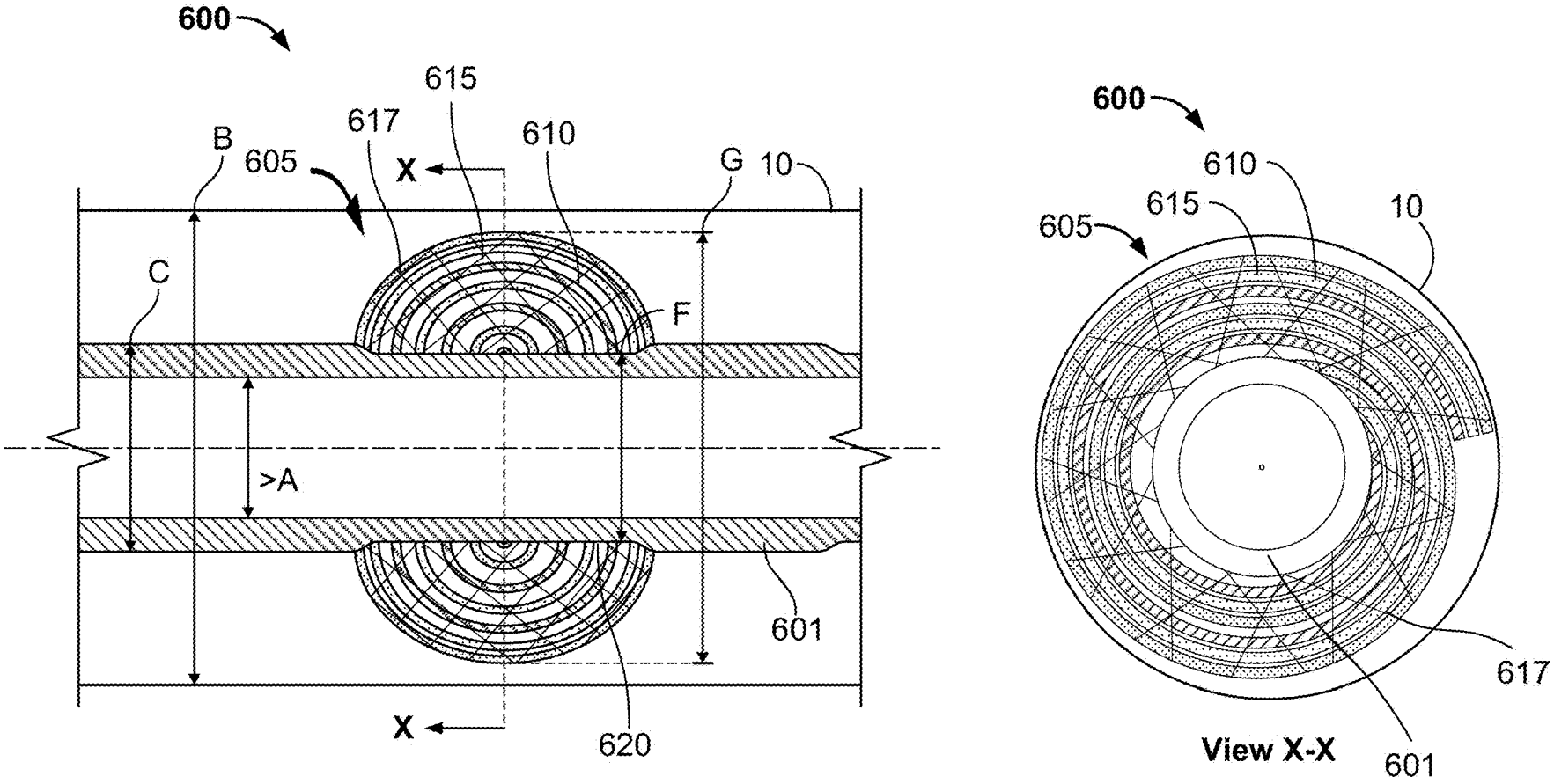
FIGS. 6A-6C are schematic illustrations of another example implementation of an anchoring system for an expandable liner and process of using same according to the present disclosure.
Figure 6B:
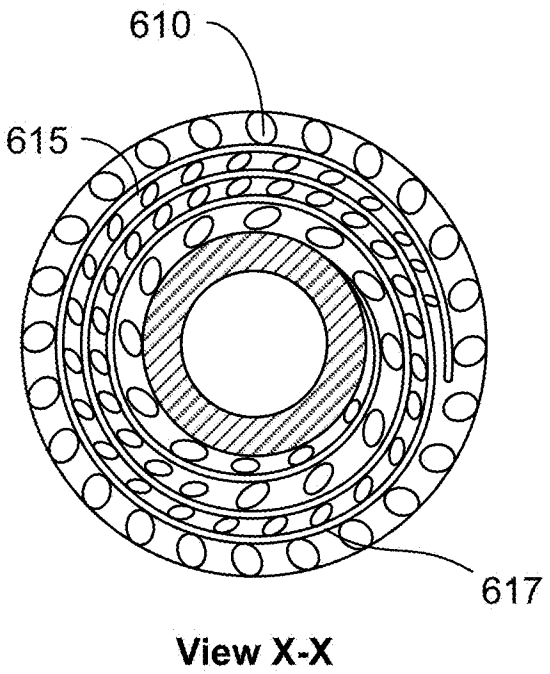
Figure 6B:
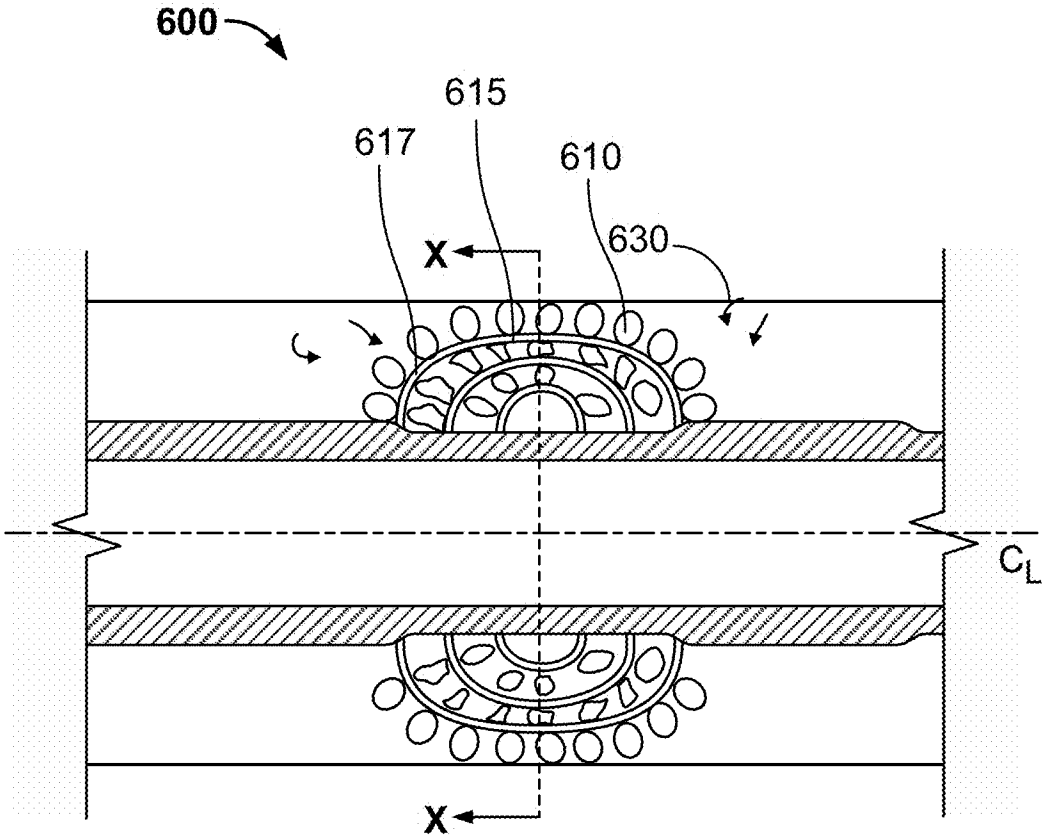
Figure 6C:
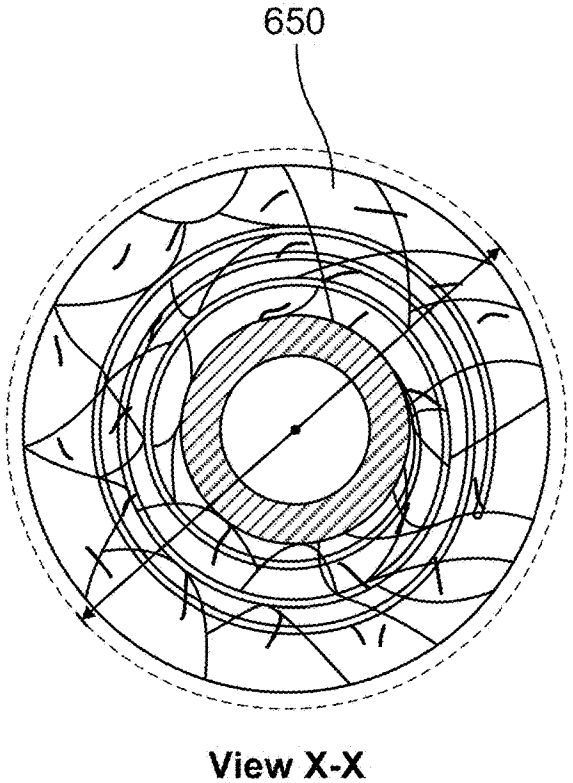
Figure 6C:
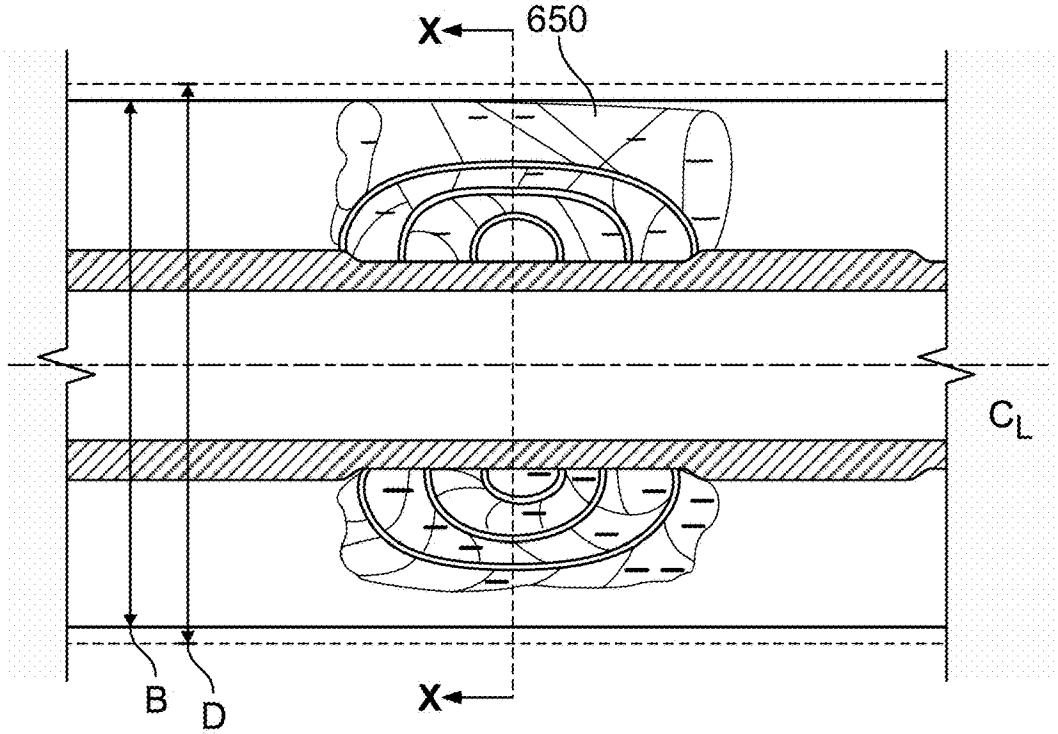

FIGS. 6A-6C are schematic illustrations of another example implementation of an anchoring system 600 for an expandable liner 605 (on a portion of an SCU 601) and process of using same according to the present disclosure. The embodiment of FIGS. 6A-6C is similar to the embodiments of FIGS. 1A-1E and 2A-2F but also is supported by secondary radial expansion using axial compression. Further, the embodiment of FIGS. 6A-6C can have the same methods and deployment as described with reference to FIGS. 4A-4E; however, the difference is how a reactive raw material 610 is embedded into a scroll mesh 615.

Figure 7:
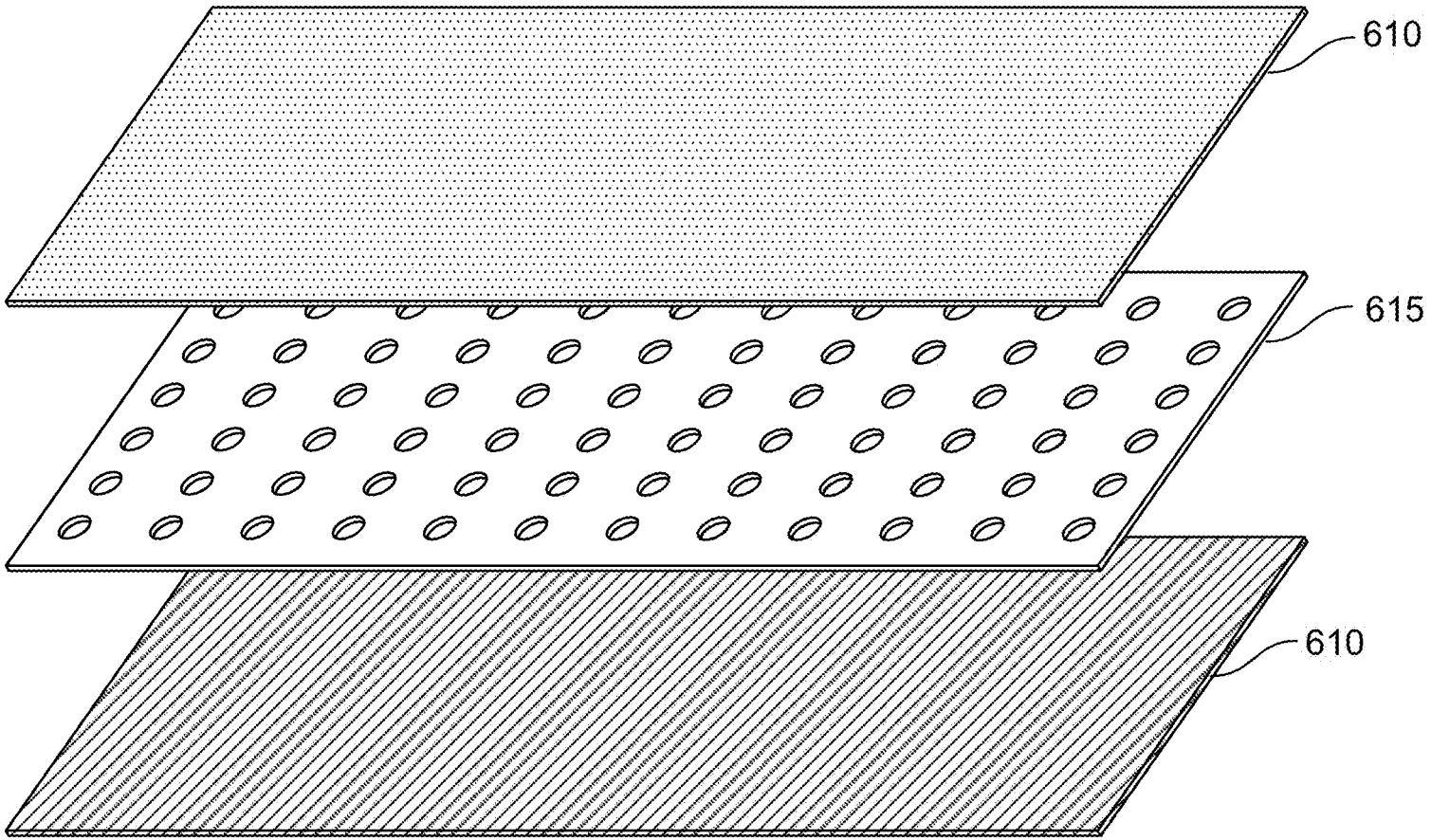
FIG. 7 are views of a scroll mesh interface structure that can be used in an anchoring system for an expandable liner according to the present disclosure.

For example, FIG. 7 shows a stack up method for the reactive raw material 610 and the scroll mesh 615 in a flat configuration. There can be a plurality of this repeated configuration with intertwined alternate structures. FIG. 7 shows one of the layering schemes representing two layers of reactive material 610 and one layer of scroll screen 615, such that once folded into a scroll, the reactive metal 610 are intertwined and embedded into the composite structure. In some aspects, the preferred geometry of the reactive raw material 610 is flat sheets. The overall structure, once constrained to the final configuration in a expandable liner groove 620, can be further optionally encapsulated by an external mesh or porous bag 617 as described in previous embodiments.

Once deployed during the expansion of the liner 605, these layers uncoil and decrease the radial gap with the open hole diameter. The reaction then progresses to expand the volume of the reactants such that in its final state, the open hole 10 is sealed and the gaps and holes inside the composite scroll mesh 615 is also filled with the expanding reactant material 610. As described with reference to FIGS. 4A-4E, this scroll mesh 615 with holes acts as a strengthening skeleton while the remnants of the external mesh act as reinforcement to the unitized structure as the conglomerates grow around and through the scroll mesh, and external mesh or porous bag. The conformal nature of the conglomerate growth achieves a seal even against ovalities and cracks in the open hole as the reactants tend to fill any available gaps.

FIG. 6A shows the expanded liner position such that the internal diameter is greater than "A" and outer diameter is "C" (where C>A but C<B). The new expanded liner groove diameter is "F." During this step in the process, the scroll mesh 615 is deployed by breaking of a pinning/locking mechanism and the stored spring force unscrolling/unwinding the scroll mesh 615 to a diameter G<B (but G>C). This allows the reactive raw material 610 to move through the interstices of the combined structure and closer to the open hole wellbore diameter. This completes the secondary expansion objective.

FIG. 6B shows the reaction progression where the reactive metal raw material 610 is exposed to well fluids 630 that include water or brine to start the chemical reactions which produce reactants having more volume than the raw material 610.

FIG. 6C shows that in the expanded position, reactive metal grows radially till it is constrained by the open hole internal diameter "C" and the expanded liner groove outer diameter "F." A sealing and anchoring force is generated at the interface through cumulative volume increase of reactants, conglomeration and adhesion among reactant entities forming a unitized structure. The scroll mesh 615 with holes acts as a strengthening skeleton while the remnants of the external mesh bag 617 act as reinforcement to the unitized structure as the conglomerates grow around and through the scroll mesh 615 and external mesh or porous bag 617. The conformal nature of the conglomerate growth achieves a seal even against ovalities and cracks in the open hole 10 as the reactants tend to fill any available gaps. A hypothetical diameter "D" (such that D>C) indicates that the volume from the reactants would occupy a much larger diameter should there have been no restriction from the open hole 10. This is how a state of interference is created generating high interface pressure for a robust seal and anchoring force.

Although not shown here, as with the other embodiments, an optional release during a pull-out-of-hole can leave the detachable unitized reactant structure 650 in hole. The reactant structure 650 collapses and falls in the well due to removal of a supporting liner from below.

Figure 8A:
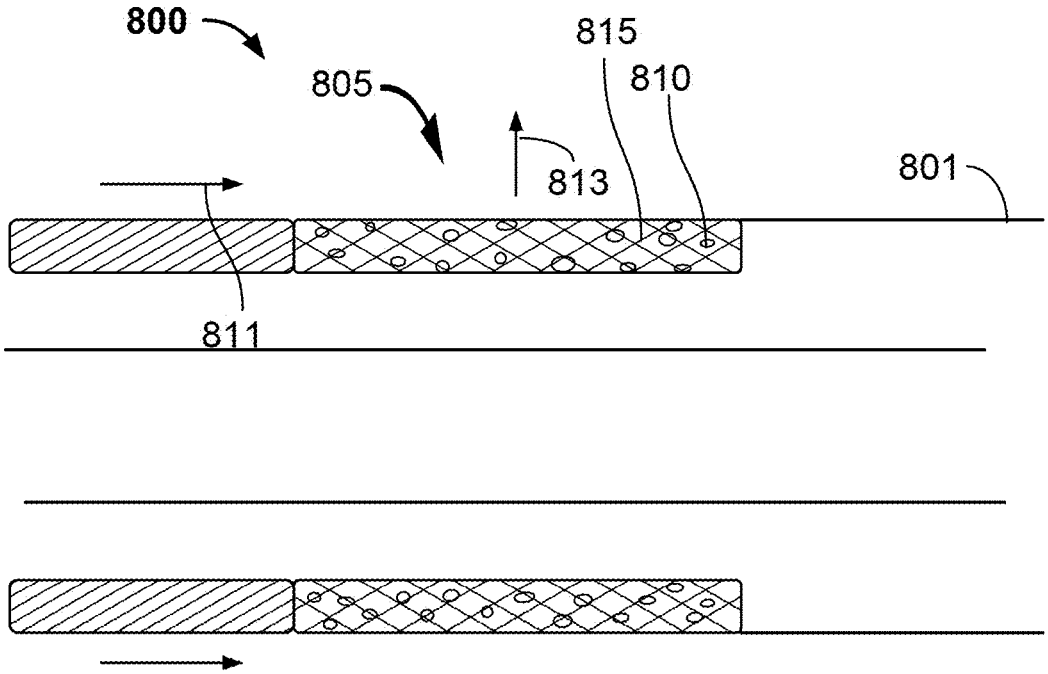
FIGS. 8A-8C are schematic illustrations of another example implementation of an anchoring system for an expandable liner and process of using same according to the present disclosure.
Figure 8B:
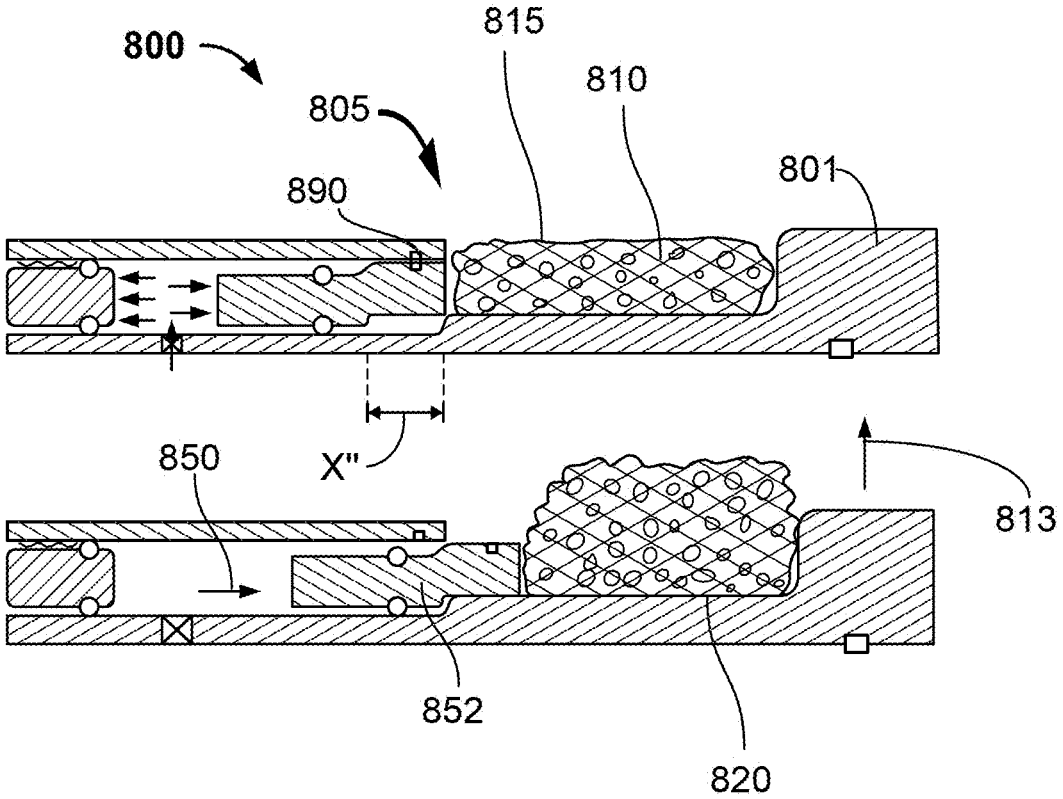
Figure 8C:
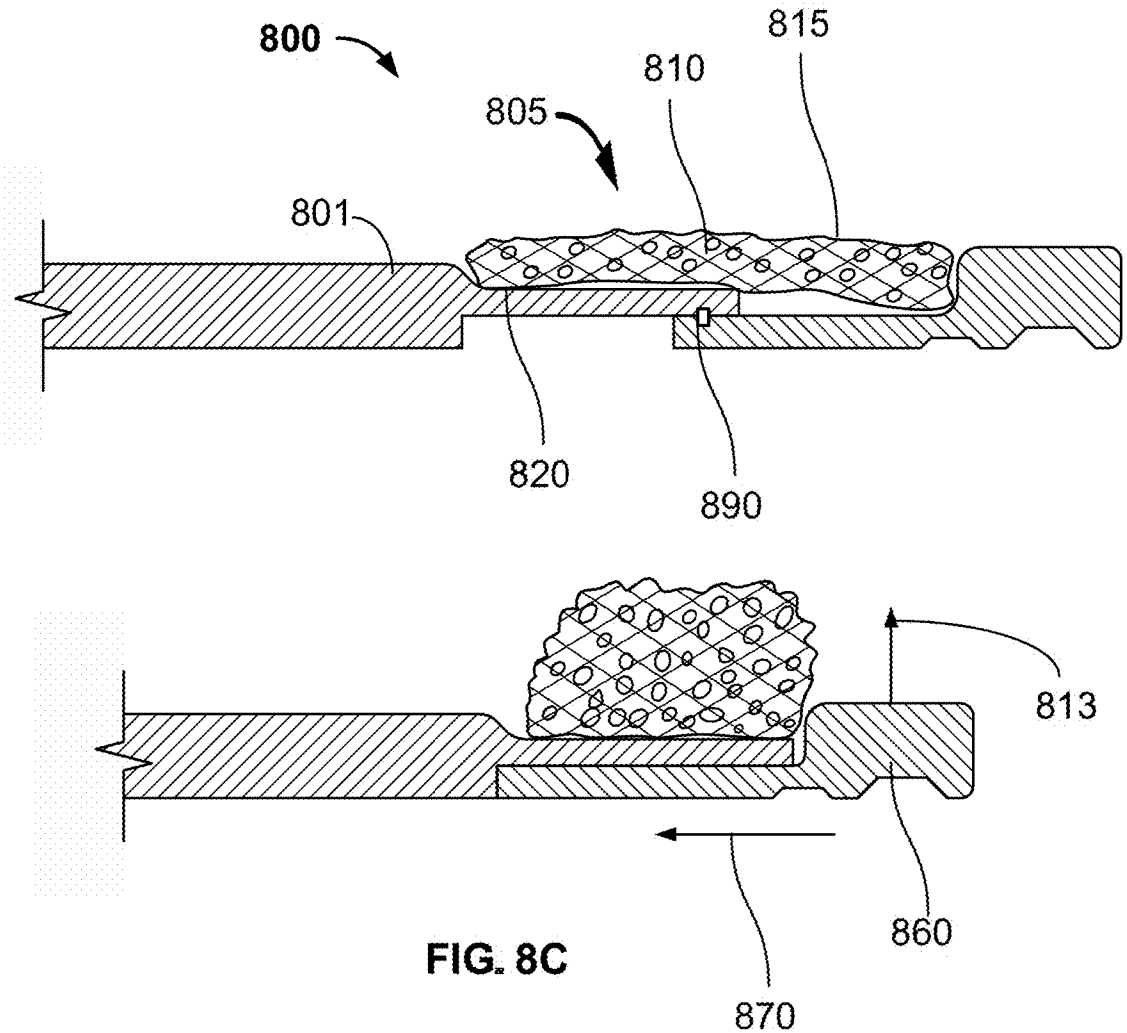

FIGS. 8A-8C are schematic illustrations of another example implementation of an anchoring system 800 for an expandable liner 805 (mounted on a portion of an SCU 801, with a reactive metal 810 enclosed within a porous or mesh bag 815) and process of using same according to the present disclosure. The embodiment of FIGS. 8A-8C is similar to the embodiments of FIGS. 1A-1E and 2A-2F but also supported by secondary radial expansion using axial compression. For example, this embodiment discloses a method for secondary radial expansion using axial compression 811 (this concept is generally shown in FIG. 8A). As shown in FIGS. 8A-8C, a hydraulic setting method with hydraulic fluid 850 urging mandrel 852 to expand the expandable liner 805 (shown in FIG. 8B), or a straight pull method (with axial force 870) with an intervention tool 860 (shown in FIG. 8C), can be used to generate axial compression on the external mesh or porous bag (as described with reference to FIGS. 1A-1E and 2A-2F). The mesh or porous bag 815 is pre-constrained on the expandable liner groove 820. The axial compression cycle is engaged after overcoming a locking/pinning mechanism 890 (which can be used in other embodiments as well). This axial compression creates a radial expansion for the mesh 815 and the contained reactive raw metal 810. The reactive metal material 810 is conformal and adjusts to the closing gap by moving and adjusting volumetrically in the radial direction 813. Once the compression is completed, the new position is locked in place through multiple existing or known methods familiar to the people in this art. Thus, a radial growth is achieved that reduces the radial gap between the reactive material 810 and the open hole diameter. Then the reaction proceeds as described in the embodiments of FIGS. 1A-1E and 2A-2F.

The embodiments discussed so far show a representation of the function and operational steps. There could be multiple combinations of these modular concepts to deploy on an SCU. FIGS. 9A-9D show an example combination that includes three separate seal and anchors from a run in hole to a pull out of hole operational sequence. The example modular configurations can be varied in size, shape, material selection and spacing among many other things associated with customization to suit the downhole application.

The example embodiment of FIGS. 9A-9D disclose a method for secondary radial expansion using axial compression. For example, as shown in FIGS. 8A-8C, a hydraulic setting method or a straight pull method with an intervention tool can be used to generate axial compression on the external mesh or porous bag (as described in the embodiment of FIG. 1A-1E or 2A-2F), which is pre-constrained on the expandable liner groove. The axial compression cycle is engaged after overcoming a locking/pinning mechanism. This axial compression creates a radial expansion for the mesh and its reactive raw metal contents. The reactive metal material is conformal and adjusts to the closing gap by moving and adjusting volumetrically in the radial direction. Once the compression is completed, the new position is locked in place through multiple existing or known methods familiar to the people in this art. Thus, a radial growth is achieved that reduces the radial gap between the reactive material and the open hole diameter. Then the reaction proceeds as described in the embodiments shown in FIGS. 1A-1E and 2A-2F.

Figure 9A:
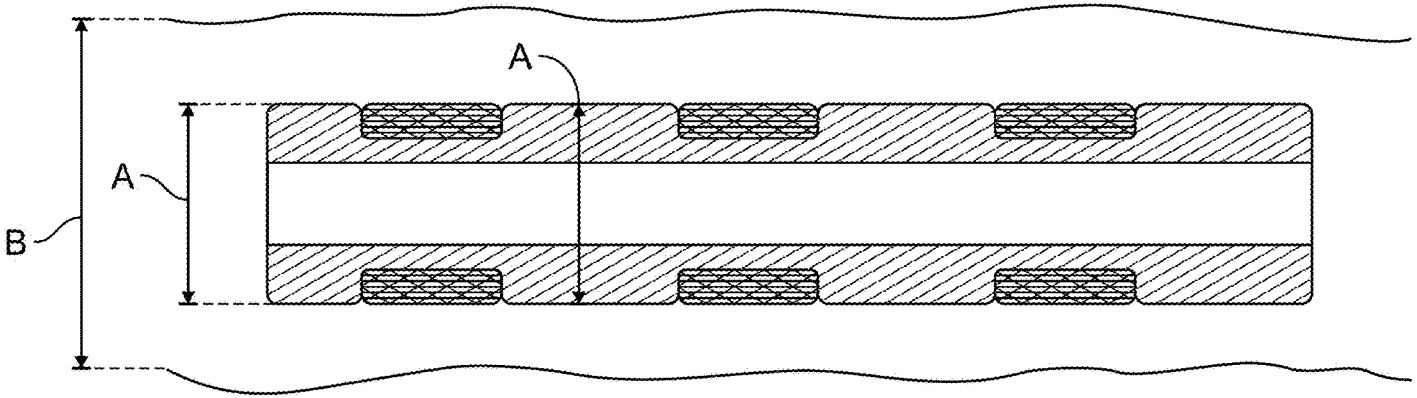
FIGS. 9A-9D are schematic illustrations of an arrangement of the example implementation of an anchoring system for an expandable liner of FIGS. 6A-6C and 8A-8C, respectively, according to the present disclosure.
Figure 9B:
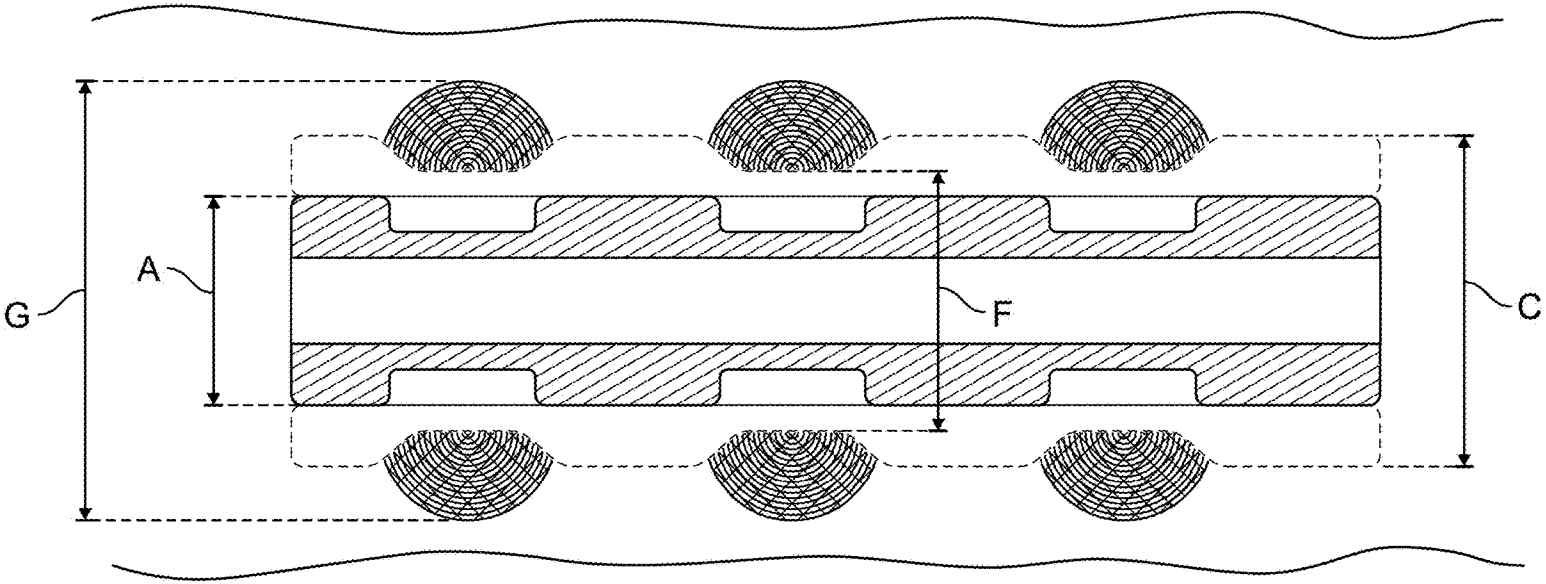
Figure 9C:
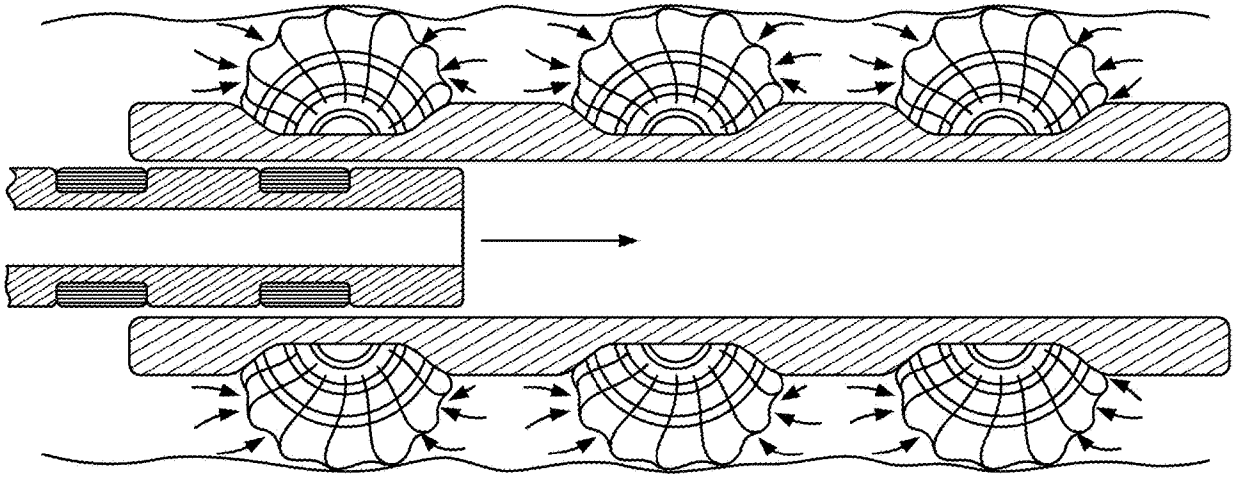
Figure 9D:
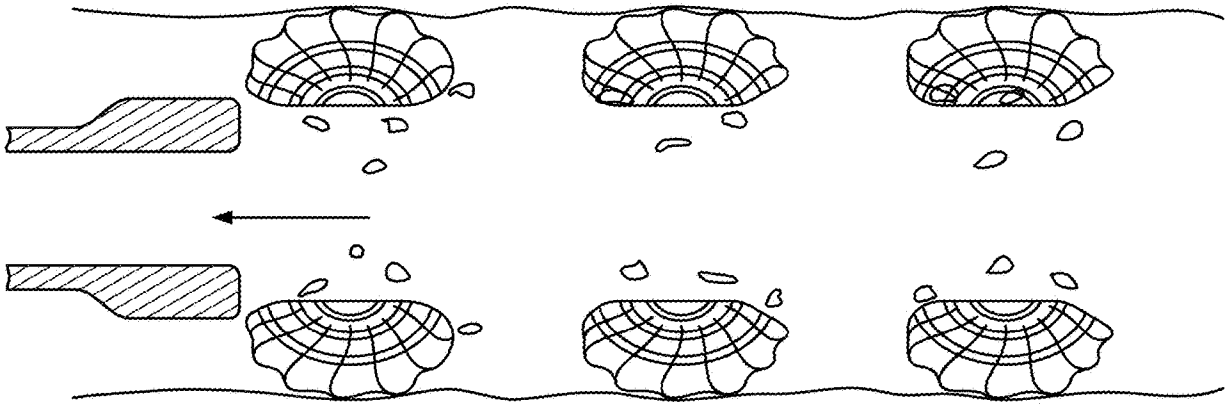

The embodiments discussed so far show a representation of the function and operational steps. There could be multiple combinations of these modular concepts to deploy on an SCU. FIGS. 9A-9D show an example combination that includes three separate seal and anchors during an operational sequence. FIG. 9A shows a run-in-hole operation with three seal and anchor systems on a SCU. FIG. 9B shows an expansion and activation of a reactive metal material within a scroll (optional) and mesh bag. FIG. 9C shows a next stage of the anchoring step and wellbore fluids that expand the reactive metal material. FIG. 9D shows an optional pull-out-of-hole/retrieval step. The modular configurations could be varied in size, shape, material selection and spacing among many other things associated with customization to suit the application.

While this specification contains many specific implementation details, these should not be construed as limitations on the scope of any inventions or of what can be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features can be described above as acting in certain combinations and even initially claimed as such, one or more features from a claimed combination can in some cases be excised from the combination, and the claimed combination can be directed to a subcombination or variation of a subcombination.

A number of implementations have been described. Nevertheless, it will be understood that various modifications can be made without departing from the spirit and scope of the disclosure. For example, example operations, methods, or processes described herein can include more steps or fewer steps than those described. Further, the steps in such example operations, methods, or processes can be performed in different successions than that described or illustrated in the figures. Accordingly, other implementations are within the scope of the following claims.

What is claimed is:

1. A thru-tubing completion system, comprising:

a sub-surface completion unit (SCU) configured to pass through a production tubing disposed in a wellbore in at least an open holed portion of the wellbore and perform completion operations in the target zone, the SCU comprising:

an expandable liner;

one or more SCU anchoring seals configured to be positioned in an un-deployed position and a deployed position, the un-deployed position of the one or more SCU anchoring seals enabling the SCU to pass through the production tubing, and the deployed position of the one or more SCU anchoring seals providing a seal against a wall of the open holed portion of the wellbore to provide zonal isolation between regions in the wellbore, the one or more SCU anchoring seals comprising a chemically active expandable metal configured to expand in the deployed position to provide the seal against the wall of the open holed portion of the wellbore; and an enclosure configured to carry the chemically active expandable metal on the expandable liner in the un-deployed position, the enclosure comprising an elastic expandable mesh or porous bag configured to expand during a transition between the un-deployed positioned and the deployed position while enclosing the chemically active expandable metal, the elastic expandable mesh or porous bag configured to expand to accommodate a radial growth of the chemically active expandable metal, the chemically active expandable metal formed as a scroll mesh that is furled in the un-deployed position and unfurled in the deployed position.

2. The thru-tubing completion system of claim 1, wherein the expandable liner comprises a groove formed on an outer surface, and the enclosure is positioned in the groove in the undeployed positioned.

3. The thru-tubing completion system of claim 1, wherein the chemically active expandable metal comprises a metal alkaline, a transition metal, or a post-transition metal.

4. The thru-tubing completion system of claim 1, wherein the chemically active expandable metal is configured to expand in contact with one or more wellbore fluids in a hydration reaction in the wellbore.

5. The thru-tubing completion system of claim 1, wherein the SCU further comprises one or more swellable elements positioned on the expandable liner adjacent the one or more SCU anchoring seals.

6. The thru-tubing completion system of claim 5, wherein the one or more swellable elements is coupled to the expandable liner with breakable elastic member.

7. The thru-tubing completion system of claim 5, wherein the one or more swellable elements acts as a sealing ring at an axial end of the chemically active expandable metal.

8. The thru-tubing completion system of claim 1, wherein the scroll mesh comprises a plurality of layers that comprise the chemically reactive expandable metal.

9. The thru-tubing completion system of claim 8, wherein the elastic expandable mesh or porous bag comprises pores sized to physically retain the chemically reactive expandable metal before, during, and after the expansion of the chemically reactive expandable metal, and the chemically reactive expandable metal is configured to conform to a volume in the elastic expandable mesh or porous bag.

10. The thru-tubing completion system of claim 1, wherein the elastic expandable mesh or porous bag comprises pores sized to physically retain the chemically reactive expandable metal before, during, and after the expansion of the chemically reactive expandable metal.

11. The thru-tubing completion system of claim 10, wherein the chemically reactive expandable metal is configured to conform to a volume in the elastic expandable mesh or porous bag.

12. A method of sealing a wellbore, comprising:

running a sub-surface completion unit (SCU) through a production tubing disposed in a wellbore to at least an open holed portion of the wellbore and perform completion operations in the target zone, the SCU comprising:

an expandable liner;

one or more SCU anchoring seals in an un-deployed position to enable the SCU to pass through the production tubing, the one or more SCU anchoring seals comprising a chemically active expandable metal; and an enclosure configured to carry the chemically active expandable metal on the expandable liner in the un-deployed position, the enclosure comprising an elastic expandable mesh or porous bag;

activating the one or more SCU anchoring seals from the un-deployed position to a deployed position by expanding the chemically active expandable metal, wherein the chemically active expandable metal is formed as a scroll mesh that is furled in the un-deployed position and unfurled in the deployed position;

during expansion of the chemically active expandable metal, expanding the elastic expandable mesh or porous bag to accommodate a radial growth of the expandable liner from the un-deployed position to the deployed position; and sealing the expandable liner against a wall of the open holed portion of the wellbore to provide zonal isolation between regions in the wellbore with the one or more SCU anchoring seals in the deployed position.

13. The method of claim 12, wherein the expandable liner comprises a groove formed on an outer surface, and the enclosure is positioned in the groove in the undeployed positioned.

14. The method of claim 12, wherein the chemically active expandable metal comprises a metal alkaline, a transition metal, or a post-transition metal.

15. The method of claim 12, wherein the chemically active expandable metal expands in contact with one or more wellbore fluids in a hydration reaction in the wellbore.

16. The method of claim 12, wherein the SCU further comprises one or more swellable elements positioned on the expandable liner adjacent the one or more SCU anchoring seals.

17. The method of claim 16, wherein the one or more swellable elements is coupled to the expandable liner with breakable elastic member.

18. The method of claim 16, wherein the one or more swellable elements acts as a sealing ring at an axial end of the chemically active expandable metal.

19. The method of claim 12, wherein the scroll mesh comprises a plurality of layers that comprise the chemically reactive expandable metal.

20. The method of claim 19, wherein the elastic expandable mesh or porous bag comprises pores sized to physically retain the chemically reactive expandable metal before, during, and after the expansion of the chemically reactive expandable metal, and the chemically reactive expandable metal is configured to conform to a volume in the elastic expandable mesh or porous bag.

21. The method of claim 12, wherein the elastic expandable mesh or porous bag comprises pores sized to physically retain the chemically reactive expandable metal before, during, and after the expansion of the chemically reactive expandable metal.

22. The method of claim 21, wherein the chemically reactive expandable metal is configured to conform to a volume in the elastic expandable mesh or porous bag.

* * * * *